US007884773B1

(12) United States Patent
Warning

(10) Patent No.: US 7,884,773 B1
(45) Date of Patent: Feb. 8, 2011

(54) HORN ANTENNA ARRAY

(75) Inventor: Fred W. Warning, Mertztown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 303 days.

(21) Appl. No.: 12/243,482

(22) Filed: Oct. 1, 2008

Related U.S. Application Data

(63) Continuation of application No. 11/412,295, filed on Apr. 27, 2006, now Pat. No. 7,444,736.

(51) Int. Cl.
*H01Q 13/10* (2006.01)

(52) U.S. Cl. ..... 343/767; 343/770

(58) Field of Classification Search ..... 343/767, 343/768, 770, 786
See application file for complete search history.

(56) References Cited

U.S. PATENT DOCUMENTS 3,482,248 A 12/1969 Jones, Jr.
4,038,742 A 8/1977 Kimball et al.
5,175,560 A * 12/1992 Lucas et al. ..... 343/767
6,552,691 B2 4/2003 Mohuchy et al.
6,867,742 B1 * 3/2005 Irion et al. ..... 343/767
6,891,511 B1 5/2005 Angelucci
6,963,312 B2 * 11/2005 Schuneman et al. ..... 343/767
6,967,624 B1 11/2005 Hsu et al.
7,170,446 B1 * 1/2007 West et al. ..... 342/372
7,193,578 B1 3/2007 Harris et al.
2003/0080911 A1 5/2003 Schuneman et al.

* cited by examiner

*Primary Examiner*—Hoang V Nguyen
(74) *Attorney, Agent, or Firm*—Duane Morris LLP

(57) ABSTRACT

A method for making a horn antenna array includes the steps of making planar boards with surface conductor or metallization defining a plurality of side-by-side horns, and with horn feed conductors extending to an edge of the boards. The edges of the board are metallized in a pattern to define feed pads in contact with the feed conductors. Slots are cut in the boards on the axes of the horns so that two orthogonal boards can be joined together for "radiation" in mutually orthogonal planes. A surface-conducive dielectric support defines surface pads in a pattern that matches the pattern of feed pads in a set of joined boards, and through vias connect from the surface pads to lower layers, which may include a beamformer, for making individual connections to the horns.

20 Claims, 17 Drawing Sheets

PLASTIC FACEPLATE
BOTTOM ISOMETRIC VIEW
300a
300ls
MOLDED IN RF CONNECTOR SHROUDS
METALIZED PLASTIC FACEPLATE
300

TOP ISOMETRIC VIEW
300US
300S2
300S2
300L
300L
3c
300 Si
3c
RF PINS
SLOTS FOR ELEMENT ATTACHMENT
300

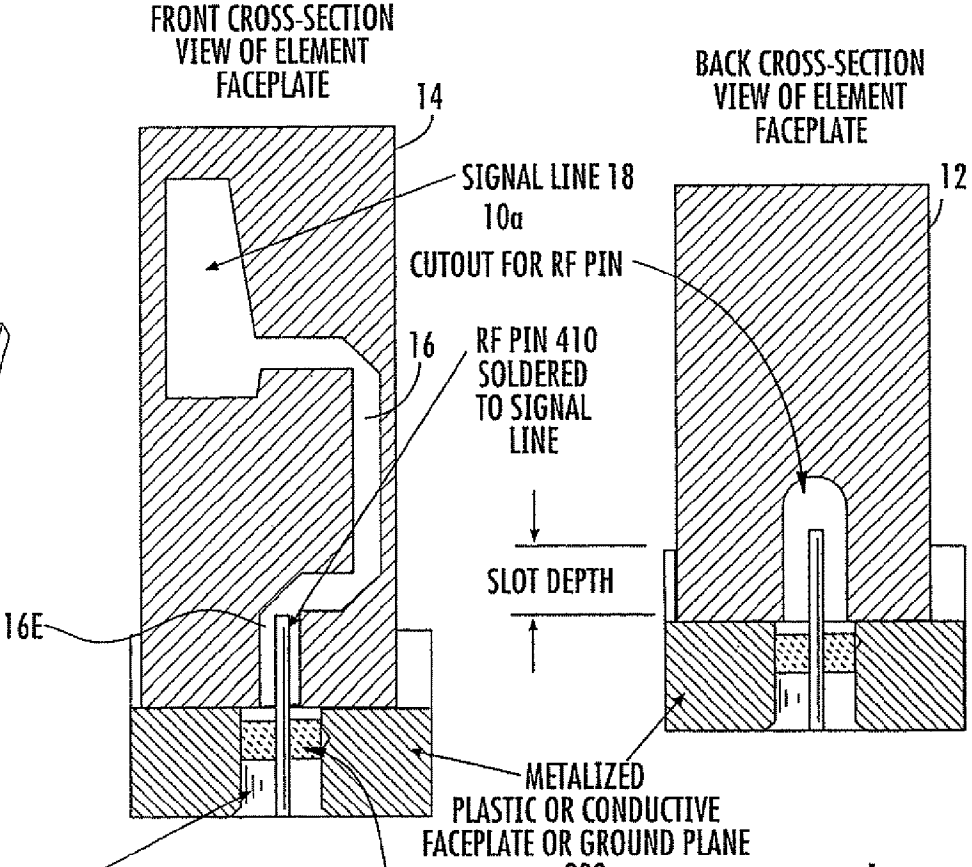
BACK CROSS-SECTION VIEW OF ELEMENT FACEPLATE
12
CUTOUT FOR RF PIN
SLOT DEPTH
METALIZED PLASTIC OR CONDUCTIVE FACEPLATE OR GROUND PLANE 300
FIG. 7b
Prior Art
FRONT CROSS-SECTION VIEW OF ELEMENT FACEPLATE
14
SIGNAL LINE 18
10a
16
RF PIN 410 SOLDERED TO SIGNAL LINE
RF DIELECTRIC 412
16E
MOLDED IN RF CONNECTOR SHROUDS OR APERTURE 300A
FIG. 7a
Prior Art

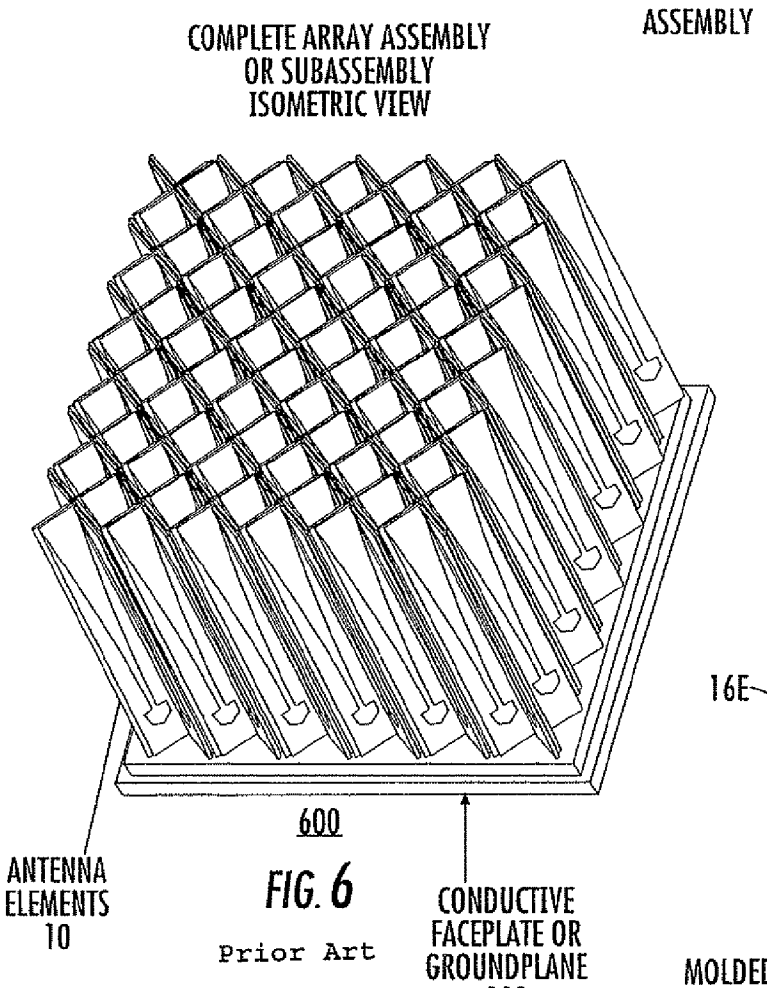
ASSEMBLY
COMPLETE ARRAY ASSEMBLY OR SUBASSEMBLY ISOMETRIC VIEW
CONDUCTIVE FACEPLATE OR GROUNDPLANE 300
600
ANTENNA ELEMENTS 10
FIG. 6
Prior Art

FRONT CROSS-SECTION VIEW OF ASSEMBLY WITH SOLDER FIXTURE

1412

HORN ANTENNA ARRAY

CROSS-REFERENCE TO RELATED APPLICATION

This is a continuation application of U.S. Non-Provisional patent application Ser. No. 11/412,295 now U.S. Pat. No. 7,444,736, filed Apr. 27, 2006 by Fred W. Warning, titled, "Horn Antenna Array and Method of Fabrication Thereof," the entirety of which application is incorporated herein by reference.

FIELD OF THE INVENTION

This invention relates to antennas and to methods for making antennas and arrays of such elements.

BACKGROUND OF THE INVENTION

Those skilled in the arts of antenna arrays and beamformers know that antennas are transducers which transduce electromagnetic energy between unguided- and guided-wave forms. More particularly, the unguided form of electromagnetic energy is that propagating in "free space," while guided electromagnetic energy follows a defined path established by a "transmission line" of some sort. Transmission lines include coaxial cables, rectangular and circular conductive waveguides, dielectric paths, and the like. Antennas are totally reciprocal devices, which have the same beam characteristics in both transmission and reception modes. For historic reasons, the guided-wave port of an antenna is termed a "feed" port, regardless of whether the antenna operates in transmission or reception. The beam characteristics of an antenna are established, in part, by the size of the radiating portions of the antenna relative to the wavelength. Small antennas make for broad or nondirective beams, and large antennas make for small, narrow or directive beams. When more directivity (narrower beamwidth) is desired than can be achieved from a single antenna, several antennas may be grouped together into an "array" and fed together in a phase-controlled manner, to generate the beam characteristics characteristic of an antenna larger than that of any single antenna element. The structures which control the apportionment of power to (or from) the antenna elements are termed "beamformers," and a beamformer includes a beam port and a plurality of element ports. In a transmit mode, the signal to be transmitted is applied to the beam port and is distributed by the beamformer to the various element ports. In the receive mode, the unguided electromagnetic signals received by the antenna elements and coupled in guided form to the element ports are combined to produce a beam signal at the beam port of the beamformer. A salient advantage of sophisticated beamformers is that they may include a plurality of beam ports, each of which distributes the electromagnetic energy in such a fashion that different beams may be generated simultaneously.

Antenna arrays are becoming increasingly important for communication and sensing. Those skilled in the design of antenna arrays know that the physical size of the elemental antennas of the array and their physical spacing in an array is an inverse function of frequency, with higher frequencies requiring smaller antenna elements and spacings than lower frequencies. As it so happens, increasing bandwidths required for more sophisticated communications and sensing tend to result in the use of higher frequencies, with the result that the fabrication of antenna arrays tends toward fabrication of small structures arrayed with small inter-element spacings.

The problems associated with the fabrication of antenna arrays is exacerbated by the need which often occurs for the ability to radiate dual polarizations, which is to say the ability to selectively radiate or receive mutually orthogonal polarizations of electromagnetic energy, often termed Electric (E) and Magnetic (M) or Vertical "V" and Horizontal "H" polarizations, regardless of the actual orientations of the fields of the polarizations. The ability to receive (and to transmit) significantly in a given polarization depends upon having a "radiating aperture" in the direction of the electric field of the desired polarization. Thus, an antenna, in order to be an effective, should have finite (non-zero) dimensions (in terms of wavelength) in the direction of the electric field to be transduced. When dual polarization (or corresponding elliptical or circular polarization) is desired, the radiating elements must extend significantly in two mutually orthogonal directions.

The prior art relating to horn antenna arrays and their fabrication includes U.S. Pat. No. 6,891,511, issued May 10, 2005 in the name of Angelucci. The Angelucci method for fabricating an antenna array includes the placing an array of clips into a ground plane. The method also includes the "printing" of an array of electrically conductive horn antenna elements onto a first dielectric circuit board (or set thereof), which first board(s) define a slot adjacent each antenna element. Such a printed board has a significant dimension only in one plane, so can only be an efficient radiator in the plane of the board. The first board(s) are mounted in a mutually parallel manner on the array of clips. A second dielectric board (or set of boards) is printed with similar conductive horns, but its slots are arranged to mate with the slots of the first board(s). The second boards are mounted onto the clips and the first board(s) so that, when mated, the second boards are mutually orthogonal to the first boards, and the horns form a rectangular array in which the antenna elements of the first boards radiate in a first polarization, and the antenna elements of the second boards radiate in a second polarization, orthogonal to the first polarization. The physical arrangement of the clips tends to stabilize the antenna array against deformation attributable to dimensional stability deviations of the dielectric materials.

The prior art also includes U.S. Pat. No. 6,967,624, issued Nov. 22, 2005 in the name of Hsu et al., which discloses a wideband antenna element and an array made from such antenna elements. The antenna elements are defined on surfaces of dielectric plates, and the feed structure is defined on a second side of one of the plates. The plates are juxtaposed with the antenna portions in registry and the feed structure sandwiched between the plates. A strip conductor portion of the feed structure extends between the plates to allow the antenna element to be fed by an unbalanced conductor.

FIG. 1*a* is a simplified perspective or isometric view of a single horn antenna element 10 according to application Ser. No. 11/245,831. Antenna 10 defines a feed end 10FE, a radiating end 10RE, and an overall length L. In FIG. 1*a*, the antenna element 10 is comprised of two juxtaposed "printed-circuit" or dielectric boards, namely an upper board 12 and a lower board 14, each having width W. Each of the upper board 12 and lower board 14 defines a feed end 12FE and 14FE, respectively, and a radiating end 12RE and 14RE, respectively. FIG. 1*b* illustrates a feed-end view of the arrangement of FIG. 1*a*. Upper board 12 includes two portions, namely a dielectric board portion 12*d* and a metallic portion 12*m*. The upper surface of dielectric board 12*d* is designated as 12*dus*, and the lower surface is designated 12*dls*. In FIG. 1*b*, upper board 12 has left and right lateral edges 12*te*1 and 12*te*2. As illustrated in FIGS. 1*a* and 1*b*, the metallic portion 12*m* of printed-circuit board 12 overlies the upper surface 12*dus* of the dielectric portion of upper board 12. The metallic portion 12*m* is cut out to define a metal-free "through aperture" designated generally as 20 and an associated horn-defining slot 30 with "matching cavity" 31, as described in copending patent application Ser. No. 10/830,797, filed Apr. 23, 2004 in the name of Hsu et al. As illustrated in FIGS. 1*a* and 1*b*, upper printed-circuit board 12 partially overlies lower printed-circuit board 14. More particularly, the lower surface 12*dls* of board 12 overlies and is generally juxtaposed with upper surface 14*dus* of lower board 14. As also illustrated in FIGS. 1*a* and 1*b*, an aperture or slot 10*a* is defined in the near end of juxtaposed boards 12 and 14.

The description herein includes relative placement or orientation words such as "top," "bottom," "up," "down," "lower," "upper," "horizontal," "vertical," "above," "below," as well as derivative terms such as "horizontally," "downwardly," and the like. These and other terms should be understood as to refer to the orientation or position then being described, or illustrated in the drawing(s), and not to the orientation or position of the actual element(s) being described or illustrated. These terms are used for convenience in description and understanding, and do not require that the apparatus be constructed or operated in the described position or orientation.

As illustrated in the end view of FIG. 1*b*, the overlap or juxtaposition of boards 12 and 14 is only partial, in that the overlap extends only over a width of W-2*t*. That is, the overlap portion is not the full width W of the boards, but is instead less by twice the thickness t of the boards. At the left in FIG. 1*b* the left lateral edge 14*te*1 of bottom board 14 extends beyond the left lateral edge 12*te*1 of upper board 12 by thickness t, and at the right lateral edge 12*te*2 of upper board 12 extends past the right lateral edge 14*te*2 of lower board 14, also by thickness t. The presence of the overlap results in a "step" or "offset" 15 adjacent each long edge of the structure 10.

FIG. 2*a* is an exploded view of the arrangement of FIGS. 1*a* and 1*b*, illustrating boards 12 and 14 exploded away from each other to illustrate some details of board 14. In FIG. 2*a*, board 14 can be seen to be similar in size to board 12. The near or upper side 14*dus* of board 14 bears a pattern of metallization, corresponding to the feed arrangement for the horn of the arrangement of the Hsu et al. patent. More particularly, the pattern of metallization includes a strip conductor 16 which is a portion of a feed transmission line terminating at an end location 16*e* adjacent the juxtaposed feed ends 12FE and 14FE of the boards 12 and 14. The pattern of metallization also includes a capacitive or load portion 18, also described by Hsu et al.

FIG. 2*b* is a perspective or isometric view of the lower or reverse side of printed-circuit board 12 of FIGS. 1 and 2*a*, illustrating the dielectric lower surface 12*dls*, and a slot 12*a* cut part-way through the thickness t of the board 12*d*. The location of slot 12*a* is selected so that it overlaps or is registered with strip conductor 16 near its end portion 16*e* when boards 12 and 14 are juxtaposed as illustrated in FIGS. 1*a* and 1*b*. The purpose of the resulting slot or aperture 10*a* is to provide access for a feed pin or center conductor (not illustrated in FIGS. 1*a*, 1*b*, 2*a*, 2*b*, or 2*c*) when the horn antenna element 10 is formed by the juxtaposition of boards 12 and 14. The feed pin will then be immediately adjacent the end portion 16*e* of feed conductor 16.

FIGS. 3*a* and 3*b* illustrate the upper and lower sides, respectively, of a ground plane 300 suited for use with the horn antenna elements 10 as described in conjunction with FIGS. 1*a*, 1*b*, 2*a*, and 2*b*. FIG. 3*c* is a cross-sectional view of the structure 300 of FIG. 3*a* looking in the direction of section lines 3*c*-3*c*. FIG. 3*d* is a plan (overhead) view of the upper side of the structure 300 of FIG. 3*a*. The structure 300 should be electrically conductive, so it may be made from metal, as suggested by the hatching of FIG. 3*c*. However, in one embodiment, the ground plane 300 is made from metallized plastic. The upper surface 300*us* of ground plane 300 defines a plurality of elongated slots, extending (having their directions of elongation) in a first direction along the surface, some of which slots are designated 300S1. The upper surface also defines a further plurality of elongated slots 300S2 with their directions of elongation orthogonal to those of slots 300S1. The pattern of crossed slots 300S1 and 300S2 creates a plurality of rectangular or square "lands," some of which are designated 300L in FIG. 3*a*.

The bottom view of ground plane 300 in FIG. 3*b* shows a pattern of through apertures 300*a* extending from lower surface 3001*s*. The apertures 300*a* extend through at least to the lower or bottom surfaces of the slots 300S1 and 300S2, and for ease of manufacture can extend completely through to the upper surface 300*us*. As illustrated in FIG. 3*c*, the lower surfaces of slots 300S1 are designated 300S1*b*. The apertures 300*a* form a rectangular pattern. The rectangular pattern of apertures 300*a* is registered with the sides of the lands 300L defined by the slots 300S1 and 300S2 on the upper side 300*us* of ground plane 300.

FIG. 3*d* is a plan view of the upper surface 300*us* of the ground plane 300 of FIGS. 3*a*, 3*b*, and 3*c*, showing how the mutually orthogonal slot sets 300S1 and 300S2 define a rectangular grid pattern defining lands 300L, and how the apertures 300*a* are centered on the sides of the lands 300L. As illustrated, the lands 300L are generally rectangular.

The through apertures 300*a* are provided to act as connector shrouds for accepting coaxial feed connectors applied from the lower side of the ground plane 300. For this purpose, each aperture 300*a* is fitted with a pin having its axis oriented parallel with the axis of the aperture. In order to carry electromagnetic signals in a guided coaxial mode, the pin must be supported by dielectric. FIG. 4 is similar to FIG. 3*c*, with the addition of pins 410 extending axially through the apertures 300*a*, supported in position by dielectric pieces 412. The dielectric pieces 412 can be glass fused to both the interior surfaces of the apertures 300*a* and to the exteriors of the pins 410, or they can be any other convenient dielectric support. Naturally, the dimensions of the pins 412 and the interior diameters of the apertures 300*a* at locations near the lower surface 3001*s* of ground plane 300 must be selected to mate with a corresponding connector, preferably an inexpensive standard connector type such as SMA. The diameter of the pins 410 near the upper side 300*us* of the ground plane 300 should be selected to provide a tight or interference fit into the aperture 10*a* in the feed end 10*fe* of the antenna 10 of FIG. 1. Ideally, the same diameter is selected to meet both these requirements. The projection of the pins 410 into the slots 300S1 or 300S2 of FIG. 4 is selected to extend into the aperture 10*a*, but not to bottom therein.

The two dielectric halves of each horn antenna are fastened together in the offset-juxtaposed manner illustrated in FIG. 1*a*, as by fusion bonding or welding, or by application of adhesive. If adhesive is used, it can be applied in liquid form and allowed to harden or cure. A suitable adhesive material may be epoxy resin. The fusion bonding or welding or the adhesive is performed or applied, as applicable, to those portions of the lower surface 12*dls* of board 12 and of the upper surface 14*dus* of board 14 which are juxtaposed as illustrated in FIGS. 1*a* and 1*b*. The conjoined board portions 12 and 14 together form a single horn antenna 10 capable of being fed at the feed end 10FE and radiating at the radiating end LORE (remembering that the antenna is reciprocal in its operation).

In order to make an array antenna, a plurality of individual horn antennas such as 10 of FIGS. 1*a* and 1*b* are produced or procured. A baseplate or ground plane 300 similar to that of FIGS. 3*a*, 3*b*, 3*c*, and 3*d* is also procured, with pins inserted as illustrated in FIG. 4.

The principles by which the individual horn antennas such as 10 of FIGS. 1*a* and 1*b* are arrayed are illustrated with the aid of FIGS. 5*a*, 5*b*, 5*c*, and 5*d*. FIG. 5*a* is a top isometric view of an assembly 500 of four horns 10, FIG. 5*b* is a bottom isometric view of the assembly of FIG. 5*a*, and FIGS. 5*c* and 5*d* are bottom views of an assembly 500 of four horn antennas 10 of FIGS. 5*a* and 5*b* at different stages of fabrication of the array. In order to fabricate the horn antenna array, each individual horn antenna 10 is conceptually juxtaposed with three other like horn antennas 10, with their steps or offsets 15 linked to form an "X" shape in end view, as illustrated in FIG. 5*c*. The four juxtaposed horns are then inserted into a slot crossing of the ground plane, as for example at the crossing of slots such as 300S1 and 300S2 of FIG. 3*a*. Additional four-horn assemblages 500 are added to the ground plane 300, fitting their steps 15 into the steps 15 of already-added four-horn assemblages 500, to form a complete horn array structure 600, at least a portion of which has the general appearance illustrated in FIG. 6. While it is conceptually appealing to view the assembly of array 600 in this manner, a possibly more practical technique is to use pick-and-place machinery to pick up individual horn antennas 10, and to individually place them in open slot positions in the baseplate. Pick-and-place machinery is well known and widely used, and those skilled in the art know how to use the technique.

During the assembly of the individual horn antenna elements 10 into the structure 600 of FIG. 6, the pick-and-place, whether performed by hand or by machinery, must be such as to fit the appropriate one of the pins 410 of FIG. 4 into the aperture 10*a* in the feed end 10FE of the corresponding horn antenna 10. FIG. 7*a* illustrates the relationship which should be maintained between a feed pin 410 and the feed conductor portions 16*e* and 16 of a dielectric board 14, and FIG. 7*b* illustrates the relationship which should be maintained between the feed pin 410 and the aperture slot 10*a* of board 12. In general, the pin 410 must be juxtaposed with, and preferably centered on, conductor portion 16*e*. Also, the pin 410 should not "bottom" in slot 10*a*, lest its presence prevent the horn antenna 10 from being held in its correct position.

Once all the pick-and-place has been accomplished to form a structure 600 similar to that of FIG. 6, reflow soldering (or possibly other fusion jointing) is performed on the entire assemblage. For this purpose, portions of the metal which are to be fused or soldered are "tinned" before assembly. Those skilled in the art know that tinning refers to pre-coating with a material which facilitates the fusion bonding process. The pre-tinned assemblage 600 is placed in a hot environment until the fusion material melts and flows, with the result that surface tension effects cause the various portions of the fusion material to fuse together. A bottom view of four mutually adjacent horn antenna elements 10 is illustrated in FIG. 5*d*, with the result of the reflow soldering or fusion illustrated as an interlaced joint 550 with solder. The assemblage is then removed from the heat and allowed to cool, with the result that the structure 600 becomes monolithic or one piece.

It will be noted that the various horn antennas 10 which are initially assembled to the baseplate or ground plane, before the soldering or fusion to make a monolithic structure, are held only at their bottoms by virtue of insertion of their feed ends into the slots of the baseplate. This may allow some play at the radiating ends of the horns as assembled into the array, which in turn may tend produce imperfect results. A jig or fixture is assembled onto the radiating ends of the horn antennas assembled into the array, to thereby fix the radiating ends of the horn antennas as well as the feed ends.

FIG. 8*a* is an isometric view of an array 600 of horn antennas 10 assembled onto a baseplate or ground plane 300, much as shown in FIG. 6, with the addition of a solder fixture 810 for holding the radiating ends of the horns of the array. For holding the radiating ends of the horns 10 of the array 600, solder fixture 810 is provided with mutually orthogonal or crossed slots, substantially equivalent to the antenna-receiving slots in the upper side of ground plane 300. These slots in the solder fixture mate with the boards of the various antennas 10 of the array, and hold them in fixed position at the top. Thus, the horn antennas 10 of the array 600 of FIG. 8*a* are held in proper position at both their tops and at their bottoms before soldering. In order to be most effective, it is desirable that the fixture 810 be readily removable after the soldering operation is finished, for which purpose the fixture 810 is made from a material, such as graphite, which resists wetting by the solder.

The antenna holding fixture 810 of FIG. 8*a* is fitted with reservoirs or means for holding solder balls. These solder balls provide a reservoir of molten solder during the reflow soldering operation to fill in any areas which might otherwise have solder gaps. In the arrangement of FIG. 8*a*, the reservoirs are illustrated as a set of apertures 812. These apertures are located over the "X" joint of each set of four juxtaposed horn antennas, most easily seen in FIGS. 5*c* and 5*d*. The reservoir apertures 812 communicate by way of funnel sections 814 with the upper portion of the juxtaposed horn antennas 10 of each set of four horn antennas, as illustrated in FIG. 8*b*. The heating associated with the reflow soldering is performed with the solder fixture 810 in place and with a ball of solder 814 in each reservoir 812. When the reflow temperature is reached, not only does the "tinning" solder melt, but so do the solder balls 814. Gravity and surface tension help the solder flow from the melted balls in the reservoirs 812 to help in filling the region between the juxtaposed steps 15 of the horn antennas 10 of the array 600.

After assembly of the horn antenna array 600 and making it monolithic, standard coaxial fittings, such as SMA fittings, or any other type, can be affixed to the apertures 300*a* and pins 410 from the bottom side 300*ts* of the ground plane 300.

Improved or alternative antenna arrays and methods for fabrication thereof are desired.

SUMMARY OF THE INVENTION

A method according to an aspect of the invention is for making a planar slot antenna, and comprises the step of procuring a dielectric board. The dielectric board so procured defines first and second broad sides, and also defines a feed edge at a feed end of the dielectric board. The dielectric board includes an electrically conductive slot antenna feed structure extending along a plane parallel with, and between, the planes of the first and second broad sides. The feed structure includes a strip conductor extending to the feed edge. The method also includes the step of applying electrically conductive material, which may be a metallization, to at least the first broad side of the dielectric board and to at least a portion of the feed edge includes the strip conductor. The application of electrically conductive material defines the slot antenna on at least the first broad side of the dielectric board in registry with the feed structure. The application of the electrically conductive material also defines an electrically conductive connection pad on the feed edge, in contact with the strip conductor, and galvanically isolated from the electrically conductive material defines the slot antenna. The application of electrically conductive material to at least the first broad side of the dielectric board may include the step of applying the electrically conductive material to (a) the second broad side of the dielectric board to thereby define a portion of the slot antenna, and (b) to portions of the feed edge remote from the connection pad.

A method according to another aspect of the invention is for making an element of an antenna array, and includes the step of procuring a dielectric first board defining first and second broad sides, and also defining a feed end edge adjacent a feed end of the first board. The first board bears on its second broad side an electrically conductive pattern defining a feed structure for a slot antenna, which feed structure includes a strip conductor extending to the feed end edge of the first board. The method also includes the step of procuring a dielectric second board defining first and second broad sides, and also defining a feed end edge adjacent a feed end of the second board. The second side of the first board is coupled to the second side of the second board so as to sandwich the feed structure between coupled first and second boards. Electrically conductive material is applied to the first sides of the coupled first and second boards and to the feed ends of the coupled first and second boards in a pattern which defines the slot antenna, and which galvanically connects the feed structure to the electrically conductive material on the first sides of the first and second boards. The feed structure is galvanically isolated from the electrically conductive material on the first sides of the coupled first and second boards to thereby make the feed structure accessible by way of the strip conductor at the feed ends of the coupled first and second boards. In one mode of this method, the step of galvanically isolating includes the step of defining apertures at the feed end of the coupled first and second boards on both sides of the feed end of the strip conductor.

A method according to another aspect of the invention is for making a horn antenna, and comprises the step of procuring a dielectric first board defining first and second broad sides, and also defining a feed end edge adjacent a feed end of the first board. The first board bears an electrically conductive material on the first broad side thereof, which electrically conductive material defines a slot horn. The first board also bears an electrically conductive material on the second broad side defining a feed structure adjacent the feed end edge of the first board. The feed structure includes a strip conductor extending to the feed end edge of the first board. The method also includes the step of procuring a dielectric second board defining first and second broad sides, and also defining a feed end edge adjacent a feed end of the second board. The second board defines on its first broad side electrically conductive material defining a slot horn including a feed region adjacent the feed end of the second board. The second broad side of the first board is juxtaposed with the second broad side of the second board to thereby generate juxtaposed boards defining a horn antenna element and a feed structure with a strip conductor sandwiched between the first and second boards. At least a portion of the dielectric material of the first and second boards is rendered conductive or metallized in a region adjacent the feed end of the strip conductor, but which is not connected to the electrically conductive material on the first sides of the first and second boards, to thereby define a feed terminal for the horn. In a particular mode of this method, the step of juxtaposing includes the application of fluid adhesive substance, which may be a hardenable fluid adhesive, to at least one of (a) the second broad side of the first board to (b) the second broad side of the second board.

A method according to another aspect of the invention is for making a planar slot antenna array. This method comprises the step of procuring a dielectric board defining first and second broad sides, and also defining a feed edge at a feed end of the dielectric board. The dielectric board includes a plurality of electrically conductive slot antenna feed structures extending along a plane parallel with, and lying between, the planes of the first and second broad sides. Each of the feed structures includes a strip conductor extending to the feed edge at spaced-apart locations. Electrically conductive material is applied to at least the first broad side of the dielectric board and to at least a portion of the feed edge including the strip conductor, to thereby define (a) the plurality of the slot antennas on at least the first broad side of the dielectric board, where each of the slot antennas is in registry with one of the feed structures and (b) the plurality of electrically conductive connection pads on the feed edge, where each of the connection pads is in contact with one of the strip conductors. The connection pads are galvanically isolated from the electrically conductive material defining the slot antennas. In one mode of this method, the step of applying electrically conductive material to at least the first broad side of the dielectric board and to at least a portion of the feed edge including the strip conductor, to thereby define the plurality of the slot antennas on at least the first broad side of the dielectric board, includes the steps of applying electrically conductive material to the entirety of the feed edge including the strip conductors, and removing a portion of the electrically conductive material adjacent each of the strip conductors. This step of removing may include the step of defining an aperture through the dielectric board at the feed edge adjacent each of the strip conductors. The step of removing may includes the step of removing a portion of the electrically conductive material from the first and second broad sides of the board at locations lying generally between some of the apertures.

A method according to another aspect of the invention is for making a planar slot antenna array. This method comprises the step of procuring a first dielectric board defining first and second broad sides, and also defining a feed edge at a feed end of the first dielectric board and a radiating edge at a radiating end of the first dielectric board. The first dielectric board includes a plurality of electrically conductive first slot antenna feed structures extending along a plane parallel with, and lying between, the planes of the first and second broad sides. Each of the first slot antenna feed structures includes a strip conductor extending to the feed edge of the first dielectric board at spaced-apart locations. Electrically conductive material is applied to at least the first broad side of the first dielectric board and to at least a portion of the feed edge including the strip conductor, to thereby define (a) the plurality of first slot antennas on at least the first broad side of the first dielectric board, with each of the first slot antennas being in registry with one of the first slot antenna feed structures, and with the first slot antennas having mutually parallel axes of symmetry, and (b) the plurality of electrically conductive connection pads on the feed edge, each of which connection pads is in contact with one of the strip conductors, and is galvanically isolated from the electrically conductive material defining the first slot antennas. This method also includes the step of procuring a second dielectric board defining first and second broad sides, and also defining a feed edge at a feed end of the second dielectric board and a radiating edge at a radiating end of the second dielectric board. The second dielectric board includes a plurality of electrically conductive second slot antenna feed structures extending along a plane parallel with, and lying between, the planes of the first and second broad sides. Each of the second slot antenna feed structures includes a strip conductor extending to the feed edge at spaced-apart locations. Electrically conductive material is applied to at least the first broad side of the second dielectric board and to at least a portion of the feed edge including the strip conductor, to thereby define (a) the plurality of second slot antennas on at least the first broad side of the second dielectric board, where each of the second slot antennas is in registry with one of the second slot antenna feed structures, and the second slot antennas have mutually parallel axes of symmetry, and (b) the plurality of electrically conductive connection pads on the feed edge, with each of the connection pads being in contact with one of the strip conductors, and galvanically isolated from the electrically conductive material defining the slot antennas. In this method, the first dielectric board which is procured further defines a plurality of physical slots, each of the physical slots of the first dielectric board extending along the axis of symmetry of one of the first slot antennas from the radiating end of the first dielectric board and having a length measured from the radiating end of the first dielectric board. The second dielectric board which is procured further defines a plurality of physical slots, each of the physical slots extending along the axis of symmetry of one of the second slot antennas from the feed end of the second dielectric board, and having a length measured from the feed end of the second dielectric board. The lengths of the first and second slots are selected so that the first and second boards can be joined at a slot with their radiating ends coplanar and their feed ends coplanar. The method also includes the step of joining the first dielectric board with the second dielectric board by placing one of the boards in a slot of the other one of the boards.

A method according to another aspect of the invention is for making an array antenna. This method comprises the step of procuring a generally rectangular first dielectric board which defines first and second broad surfaces, and also defines feed and radiating end edges lying orthogonal to the first and second broad surfaces. The first dielectric board defines a slot horn antenna lying on at least one of the first and second broad surfaces, and defining an axis. The first dielectric board further defines a first slot extending along the axis from the radiating end edge toward the feed end edge. The first dielectric board also defines a feed conductor lying on and in the plane of the feed edge. The method also includes the step of procuring a generally rectangular second dielectric board defining first and second broad surfaces, and feed and radiating end edges lying orthogonal to the first and second broad surfaces. The second dielectric board also defines a slot horn antenna lying on at least one of the first and second broad surfaces. The slot horn antenna defines an axis. The second dielectric board defines a second slot extending along the axis from the feed end edge toward the radiating end edge, and also defines a feed conductor lying on the feed edge and in the plane of the feed edge. The lengths of the first and second slots are selected in conjunction with the lengths of the first and second dielectric boards so that when the first and second slots of the first and second boards are interlinked, the planes of the feed end edges of the first and second dielectric boards lie in the same plane. According to an aspect of the invention, the first and second slots of the first and second dielectric boards are interlinked to form an interlinked structure, where the interlinked structure has the planes of the first and second broad sides of the first and second dielectric boards lying in mutually orthogonal planes. When the structures are interlinked, the feed conductors of the first and second dielectric boards define a two-dimensional pattern lying in the planes of the feed end edges of the first and second dielectric boards. A dielectric base plate defining a generally planar broad surface is procured, where the planar broad surface of the dielectric base plate defines individual electrically conductive pads arranged in the two-dimensional pattern. The feed-end edges of the first and second dielectric boards are affixed to the broad surface of the base plate with the feed conductors of the first and second dielectric boards registered with the electrically conductive pads and in electrical contact therewith.

BRIEF DESCRIPTION OF THE DRAWINGS

FIG. 6 is an isometric view of a portion of a horn array antenna;

FIG. 7*a* is a front cross-sectional view of a portion of a horn element mounted in the ground plane of FIG. 4*a*, and FIG. 7*b* is a rear or back cross-section thereof.

DESCRIPTION OF THE INVENTION

Figure 9:
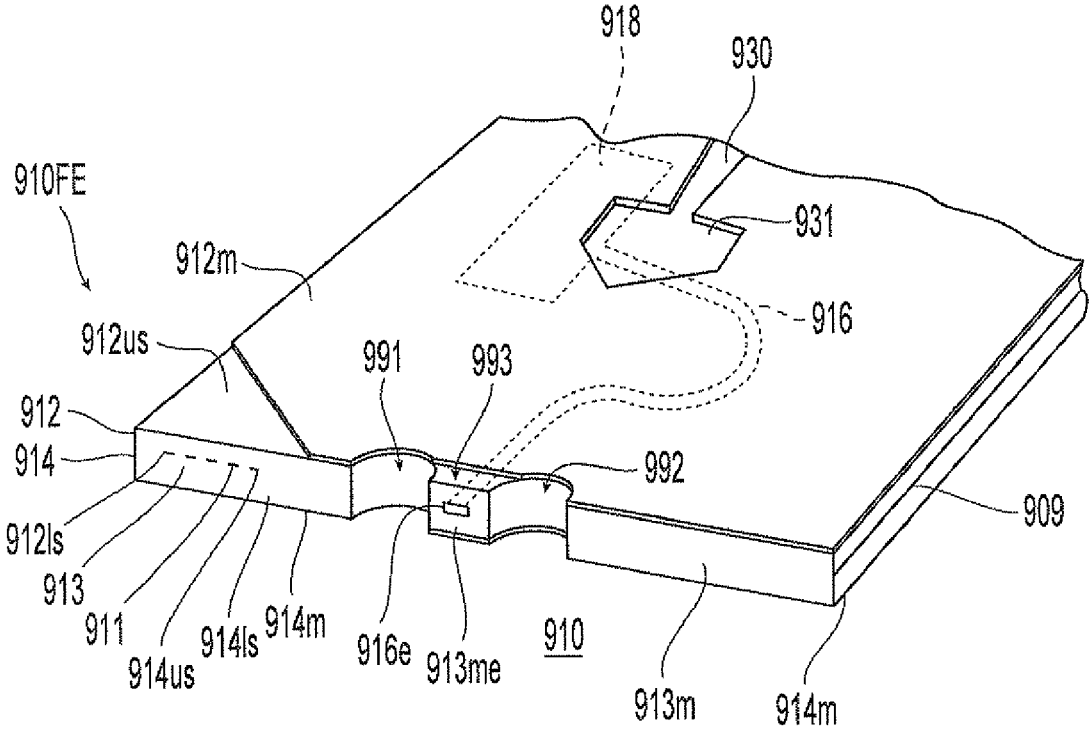
FIG. 9 is a simplified perspective or isometric view of a feed-end portion of a horn antenna element according to an aspect of the invention, showing the application of an electrically conductive layer or metallization, partially cut away, over the exposed broad sides of the juxtaposed dielectric boards and over the exposed feed-end edge, except in the region of the strip conductor.

FIG. 9 illustrates a portion of juxtaposed, preferably joined, dielectric boards designated 912 and 914. The plane of the juxtaposition is designated 911. These boards are made generally by prior art methods. The illustrated portion of the structure 910 is near the feed end 910FE. The joined boards 912 and 914 together define a feed-end edge designated 913. The near or upper surface 912*us* of the joined boards 912,914 is covered with a pattern of electrically conductive material 912*m*, which may be a metallization, defining a slot antenna 930 (only a portion of which is visible) and its matching cavity 931. A dash line region illustrates the location and path of the feed structure 918 and the feed strip conductor 916, and also of the feed end 916*e* of the strip conductor. According to an aspect of the invention, the metallization includes a portion designated 913*m*, which extends onto the edges 913 of the juxtaposed or joined dielectric boards 912,914. A portion 913*me* of metallization portion 913*m* makes galvanic electrical contact with that edge 916*e* of strip conductor 916 which would be exposed but for the presence of the metallization. In this context, "galvanic" means electrically connected for the flow of direct current, and does not include capacitive coupling. As so far described, there is no way to feed the slot antenna 930 by way of the strip conductor 916, because the feed end 916*e* of the strip conductor 916 is "connected to ground." In order to galvanically isolate the strip conductor 916, a portion of the metallizations 912*m*, 913*m*, and 914*m* surrounding the strip conductor end 916*e* is removed. This can be easily accomplished by defining a pair of apertures 991, 992 near the feed end of the joined boards 912. Apertures 991 and 922 cut through the dielectric and the metallization thereon, providing most of the galvanic isolation. Removal of a strip of the conductive metallization in the region 993 between apertures 991 and 992 completes the galvanic isolation of portion 913*me* from the "ground" metallization 912*m*, 911*m*, and 914*m*. The apertures 991 and 992 are easily made, as by drilling or broaching. The removal of the metallization over strip 993 and the matching portion (not illustrated) on the lower side of the structure 910 is easily accomplished with simple tools. The result of these operations is to affix an electrically conductive pad 913*me* to the feed end 916*e* of strip conductor 916, isolated from the ground metallization 912*m*, 911*m*, and 914*m*. The electrically conductive pad 913*me* can be used to make electrical connections for driving the antenna 930.

Figure 10A:
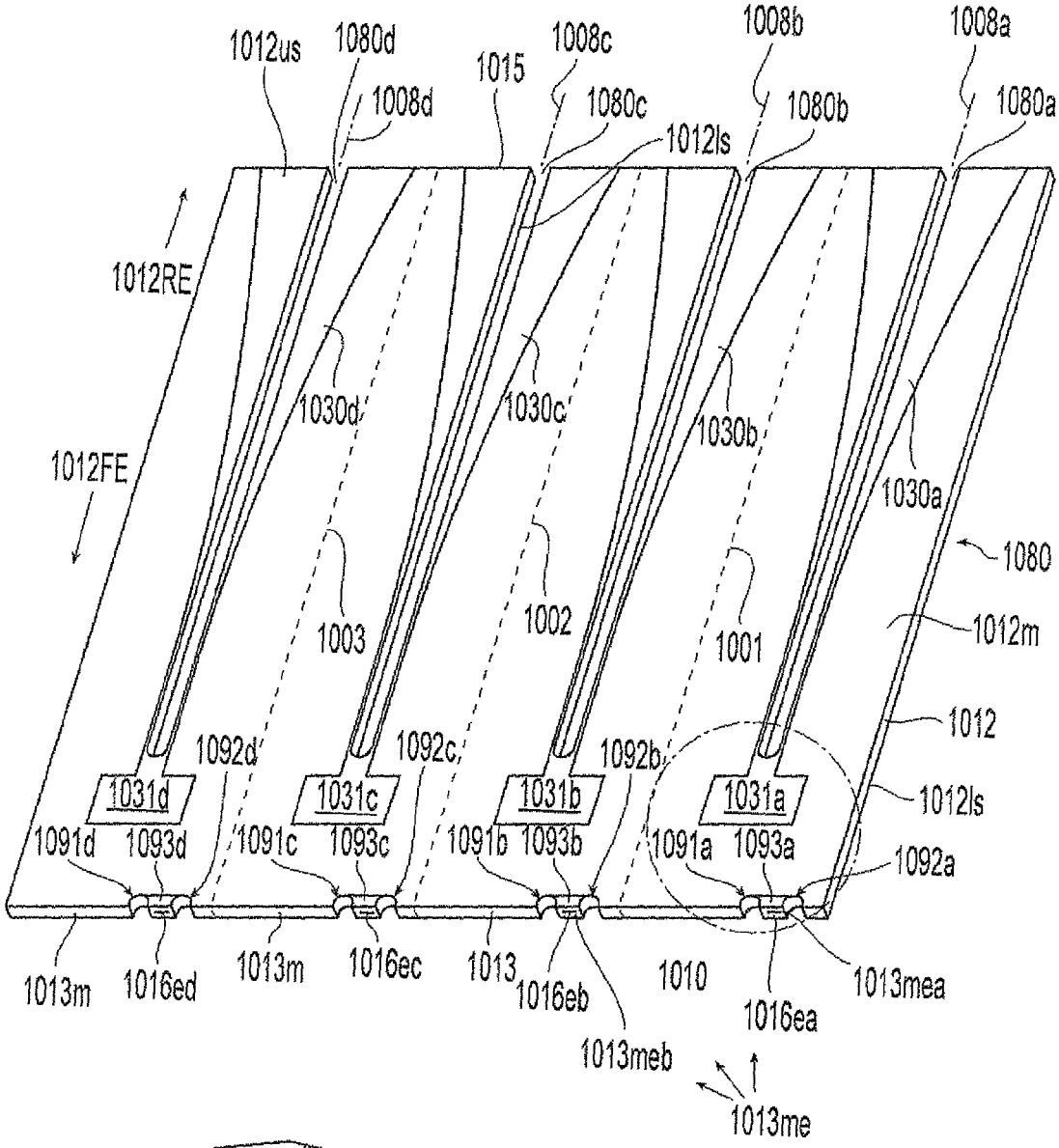
FIG. 10*a* is a simplified perspective or isometric view of a first type of antenna array illustrating juxtaposed dielectric boards with electrically conductive material extending over their broad near surfaces in patterns which define a plurality of slot horns.

FIG. 10*a* is a perspective or isometric view of a structure 1010 including a set of four horn antennas as described in conjunction with FIG. 9 defined on a "single" board 1012. The individual antenna portions are separated by three dash lines 1001, 1002, and 1003. It will be appreciated that board 1012 and its feed-end 1012FE edge 1013 are covered with metallization designated 1012*m* except where the antennas 1030*a*, 1030*b*, 1030*c*, and 1030*d* and their feed cavities 1031*a*, 1031*b*, 1031*c*, and 1031*d* are defined. Also, the edge metallization makes contact with the feed ends 1016*ea*, 1016*eb*, 1016*ec*, and 1016*ed* of the feed conductors, and a feed-end pad 1013*me* of a set 1013*me* is associated with each feed end conductor 1016*ea*, 1016*eb*, 1016*ec*, and 1016*ed* to define pads, two of which are designated 1013*mea* and 1013*meb*. Each of the pads of set 1013*me*, such as pads 1013*mea* and 1013*meb*, are surrounded by a nonmetallized region or "moat" where isolation is required, as generally described in conjunction with FIG. 9. In addition, the metallization around the feed ends 1016*ea*, 1016*eb*, 1016*ec*, and 1016*ed* and their pads, including pads 1013*mea* and 1013*meb*, is removed in the regions within apertures 1091*a*, 1091*b*, 1091*c*, 1091*d*, 1092*a*, 1092*b*, 1092*c*, and 1092*d*, and adjacent strips 1093*a*, 1093*b*, 1093*c*, and 1093*d*, as well as corresponding strips (not illustrated) on the bottom of the structure 1010 of FIG. 10.

FIG. 10*a* also illustrates elongated slots cut through the dielectric board 1012 from the radiating ends 1012RE to a location near the matching cavities 1031. More particularly, a set of four slots 1080*a*, 1080*b*, 1080*c*, and 1080*d* are cut through board 1012 along the longitudinal axes 1008*a*, 1008*b*, 1008*c*, and 1008*d* of horns 1030*a*, 1030*b*, 1030*c*, and 1030*d*, respectively. These slots are used to aid in mounting the horn array of structure 1010 into an array antenna.

Figure 10B:
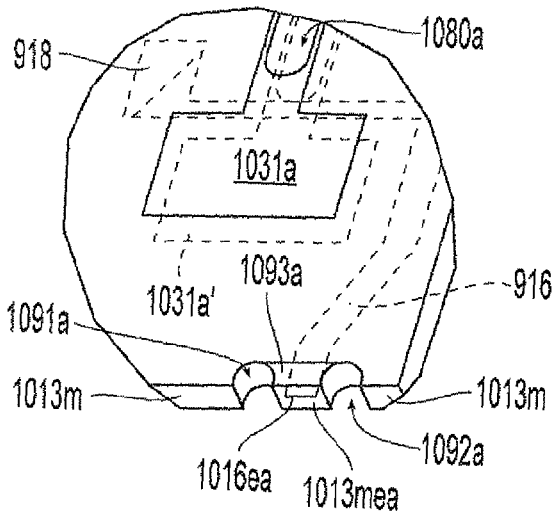
FIG. 10*b* is a detail thereof.

FIG. 10*b* is a view of a portion of the structure 1010 of FIG. 10*a*, showing additional details. In FIG. 10*b*, the matching cavity 1031*a*' on the reverse side of the structure is illustrated by dash lines, and the edge metallization 1013*mea* making contact with the feed end 1016*ea* of the strip feed conductor 916 is also visible. Structures such as 1012 of FIGS. 10*a* and 10*b* are used in an antenna array according to an aspect of the invention to transduce a particular linear polarization.

The structure 1010 of FIG. 10*a*, when energized with electromagnetic energy, can transduce (transmit or receive) in a single linear polarization as known to those skilled in the antenna arts, namely that polarization in which the electric field lies parallel with the broad upper and lower surfaces of the structure. It is often desirable to be able to transduce in two mutually orthogonal polarizations. The structure 1010 of FIG. 10*a* is arranged to coact with the structure 1110 of FIG. 11*a* to produce an array (or a portion of an array) capable of transducing electromagnetic energy in two mutually orthogonal linear polarizations. The ability to respond to two mutually orthogonal linear polarizations also makes it possible to make the structure responsive to elliptical or circular polarization.

Figure 11A:
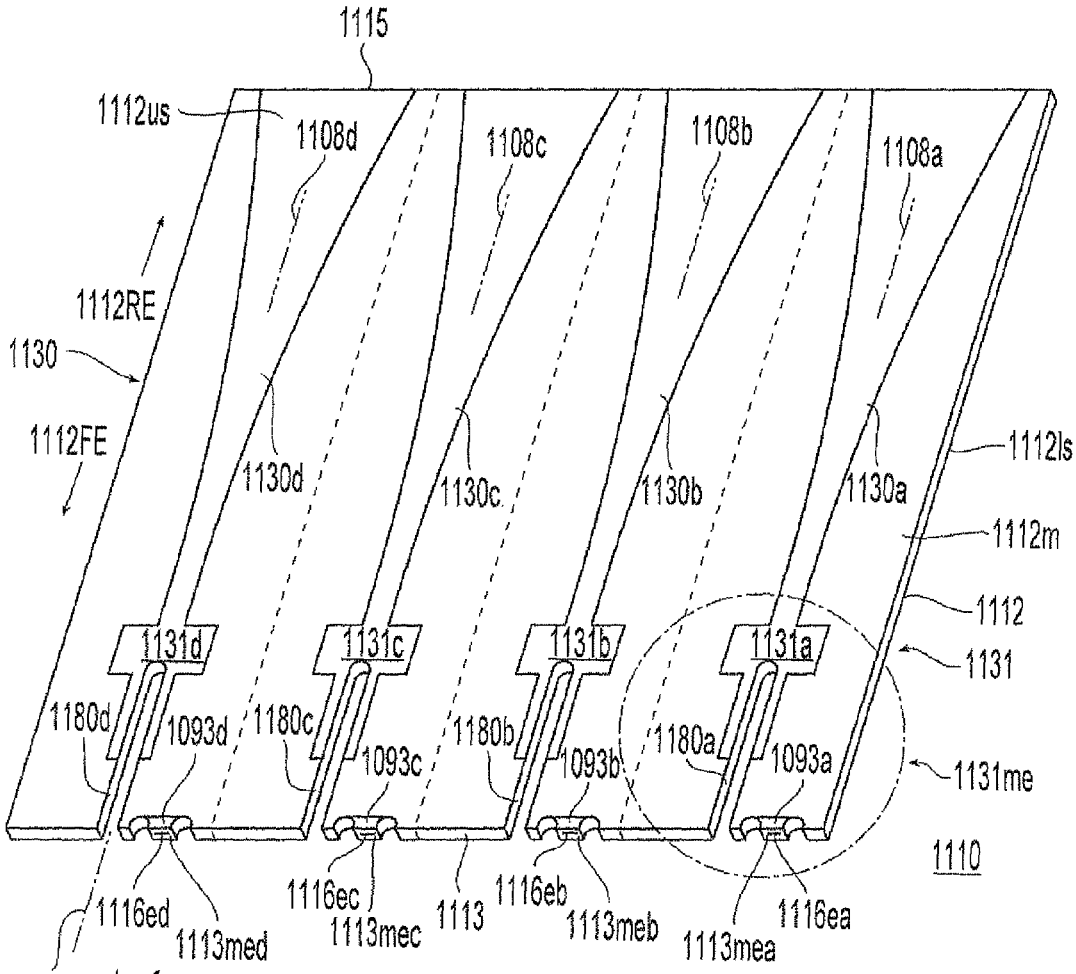
FIG. 11*a* is a simplified perspective or isometric view of second type of antenna array illustrating juxtaposed dielectric boards with electrically conductive material extending over their broad near surfaces in patterns which define a plurality of slot horns.
Figure 11B:
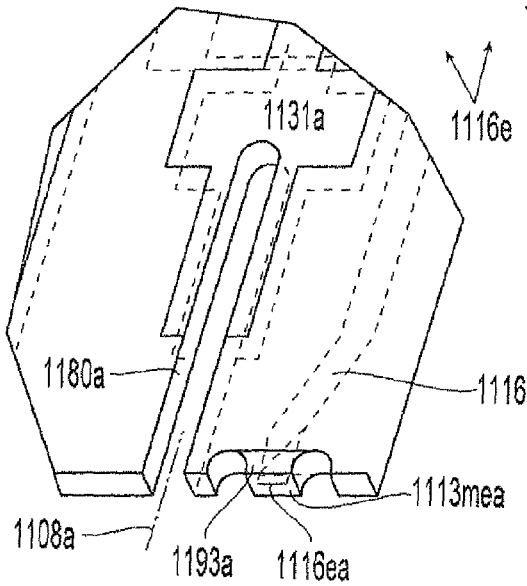
FIG. 11*b* is a detail thereof.

In FIG. 11*a*, structure 1110 is generally similar to structure 1010 of FIG. 10*a*. FIG. 11*b* illustrates a detail of the structure 1110. Thus, structure 1110 includes a generally planar dielectric board structure 1112 which comprises two separate dielectric boards (not separately illustrated) with a feed structure sandwiched therebetween (illustrated in FIG. 10*b*). The broad upper surface of structure 1110 is metallized 1112*m* in a pattern which defines four horn antennas 1130*a*, 1130*b*, 1130*c*, and 1130*d*, each centered on a longitudinal axis 1108*a*, 1108*b*, 1108*c*, and 1108*d*, respectively. The metallization 1112*m* also defines a horn matching cavity set 1131, including horn matching cavity 1131*a* of horn 1130*a*. Each cavity of set 1131 of the feed-end structure of each horn antenna element 1130*a*, 1130*b*, 1130*c*, and 1130*d* of structure 1110 has a shape which may differ from that of cavities of set 1031 of FIG. 10*a*, because, where the two board assemblies from of FIGS. 10*a* & 11*a* slide into each other, the metal cavities labeled 1031 lie below the cavity 1131 when assembled. The cavity 1131 is modified to remove metal from the 1031 cavity region, as can be easily seen in FIG. 12*a*. The feed structure of the horns of set 1130 of horns includes feed-end conductors of a set 1116*e*, including conductors 1116*ea*, 1116*eb*, 1116*ec*, and 1116*ed*. The edge metallization includes a contact pad component which overlies and makes electrical contact with the feed-end conductor set 1116*e*. The contact pad components associated with conductors 1116*ea*,

1116*eb*, 1116*ec*, and 1116*ed* are designated 1113*mea*, 1113*meb*, 1113*mec*, and 1113*med*, respectively, of a set 1113*me* of contact pads.

Figure 12A:
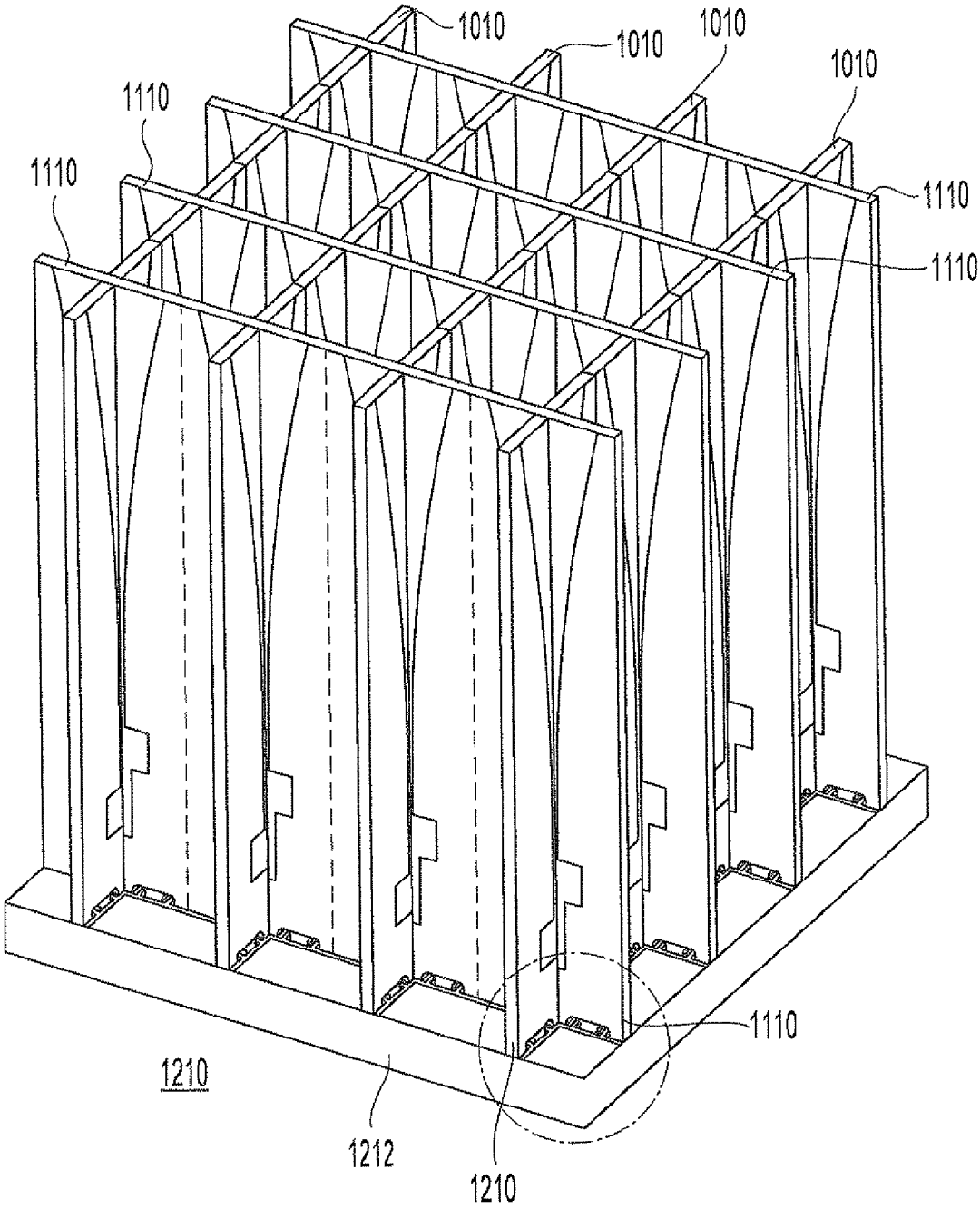
FIG. 12*a* is a simplified perspective or isometric view of an array of antennas according to an aspect of the invention sitting on a base.

The arrangement of structure 1110 of FIG. 11*a* includes slots extending parallel to the longitudinal axes of the horn antennas. However, the slots 1180*a*, 1180*b*, 1180*c*, and 1180*d* of set 1180 of slots illustrated in FIGS. 11*a* and 11*b* differ from the slots 1080*a*, 1080*b*, 1080*c*, and 1080*d* of set 1080 of slots of FIGS. 10*a* and 10*b*. More particularly, the slots of set 1180 extend from the feed end 1112FE of structure 1110 toward radiating end 1112RE. The lengths of slots 1180*a*, 1180*b*, 1180*c*, and 1180*d* of set 1180 of slots are sufficient to extend part-way into the matching cavities 1131*a*, 1131*b*, 1131*c*, and 1131*d* of set 1131 of matching cavities. The length of each slot of set 1180 of structure 1110 when combined with the length of a slot of set 1080 of structure 1010 is equal to or greater than the length of either structure 1110 or 1110 as measured between the feed and radiating ends. Put another way, the length of each slot of set 1180 of structure 1110 when combined with the length of a slot of set 1080 of structure 1010 is equal to or greater than the length of either structure 1110 or 1110 in a direction parallel to the axes 1008 or 1108. This dimensioning of the slots allows the boards or structures 1010 and 1110 to be interlocked by sliding the feed end(s) of structure(s) 1110 onto the radiating end(s) of structure(s) 1010, as illustrated in FIG. 12*a*, to make an array 1210 of mutually self-supporting structures. Juxtaposed portions of the interlocked boards can be mechanically fastened, as for example by adhesives, and this mechanical fastening can include an electrical contact aspect if the adhesive is electrically conductive. Metallic fusion fastening can also be used, as by soldering or brazing of juxtaposed metallic "ground" portions.

Figure 1A:
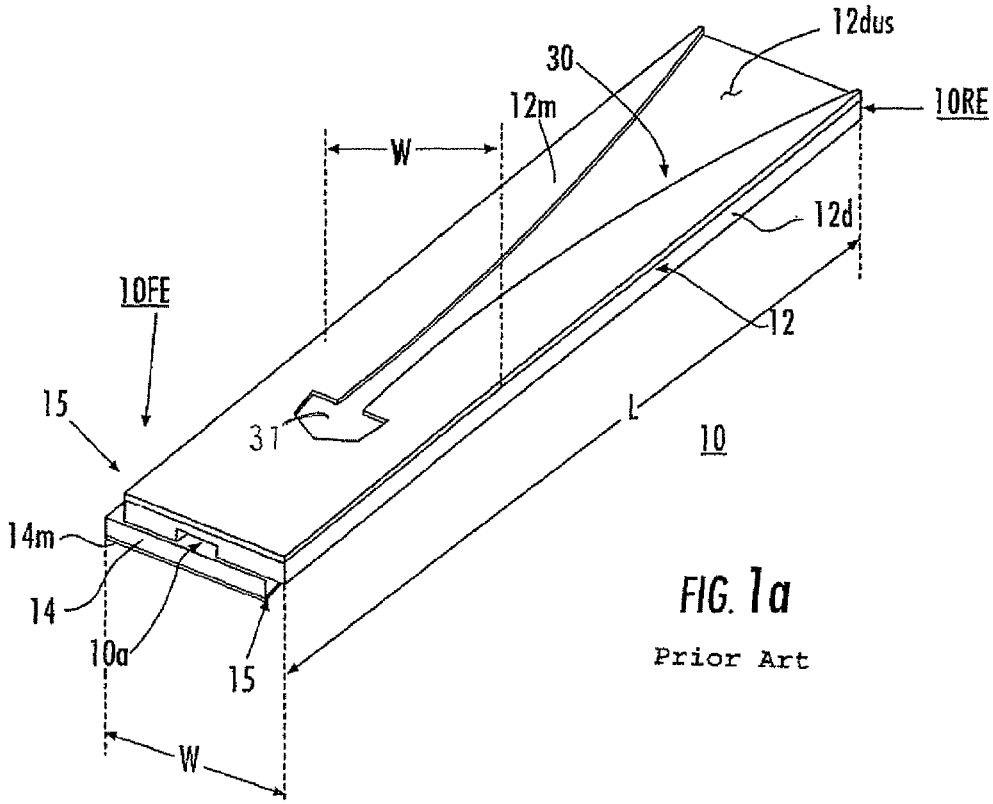
FIG. 1a Prior Art
FIG. 1*a* is a simplified perspective or isometric view of a horn antenna element according as set forth in U.S. patent application Ser. No. 11/245,831, filed Oct. 7, 2005 in the name of Harris et al., and including juxtaposed printed circuit boards.
Figure 1B:
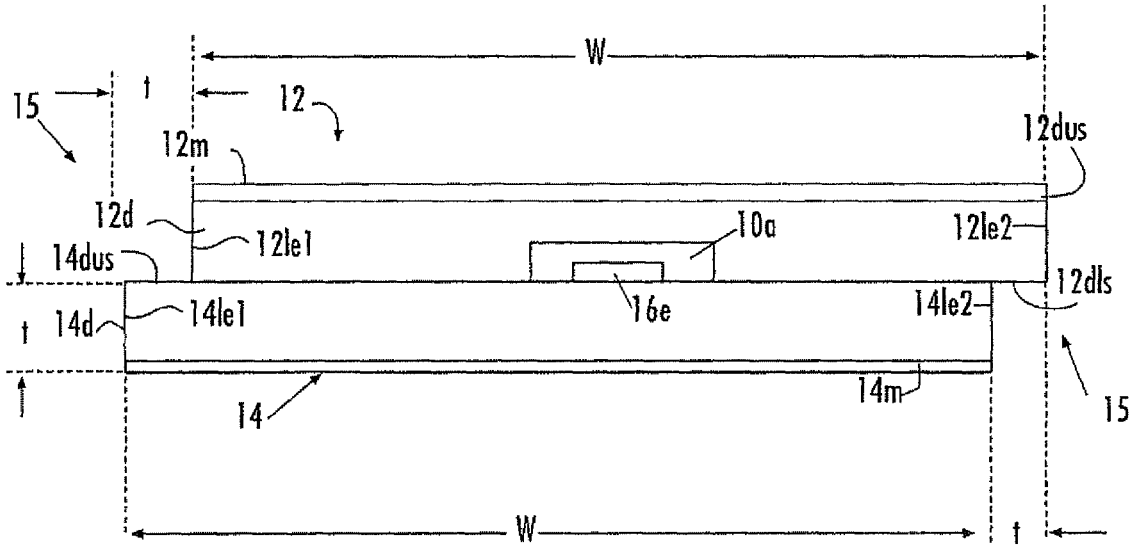
Prior Art FIG. 1b
FIG. 1*b* is an end view thereof.
Figure 2A:
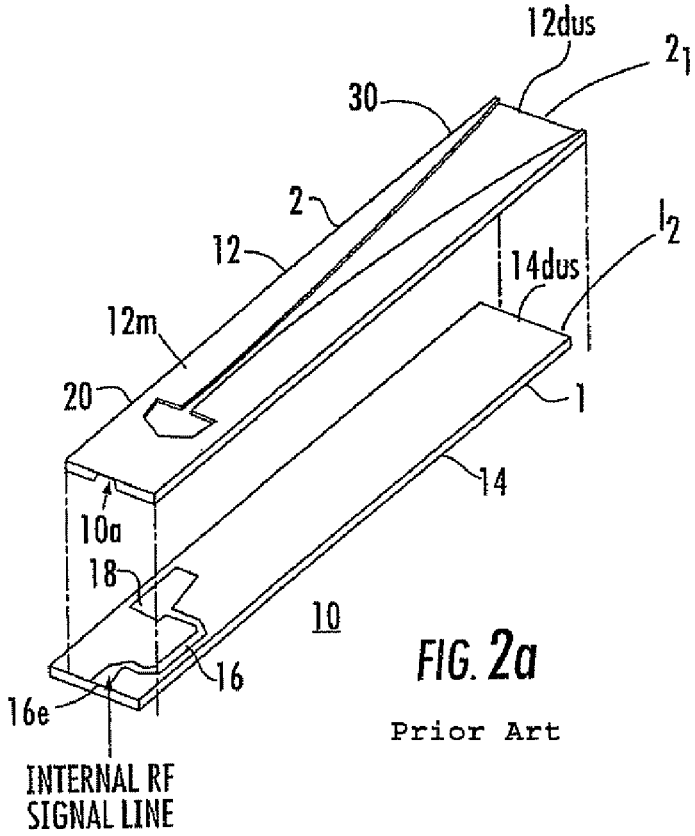
FIG. 2a Prior Art
FIG. 2*a* is a simplified exploded view of the arrangement of FIGS. 1*a* and 1*b*.
Figure 2B:
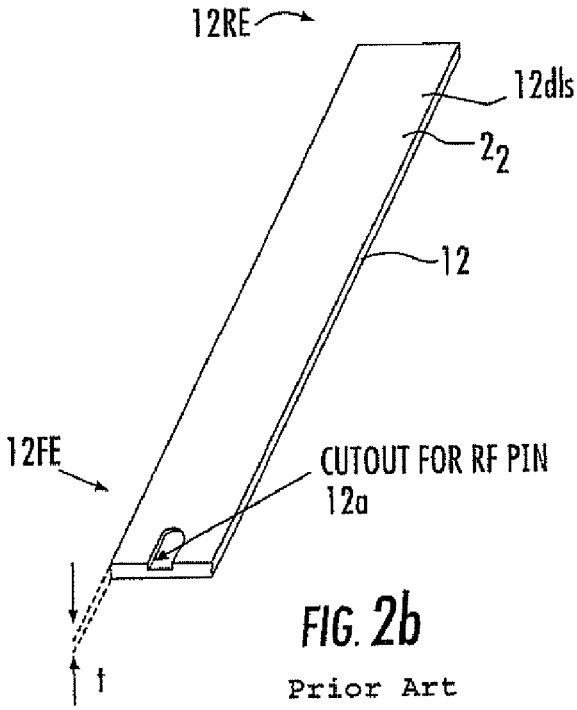
FIG. 2b Prior Art
FIG. 2*b* illustrates the reverse side of the upper board of FIGS. 1*a* and 1*b*.
Figure 2C:
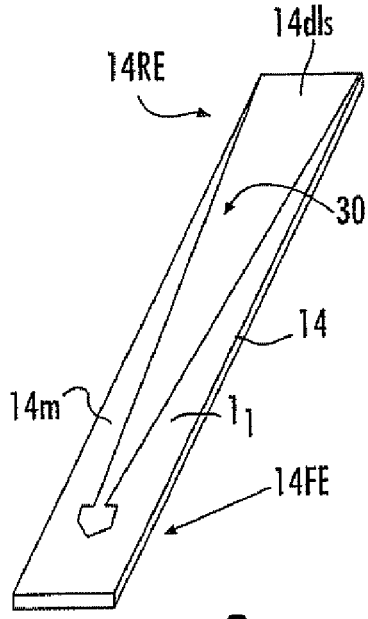
FIG. 2c Prior Art
FIG. 2*c* illustrates the reverse side of the lower board of FIGS. 1*a* and 1*b;*
Figures 3A, 3B:
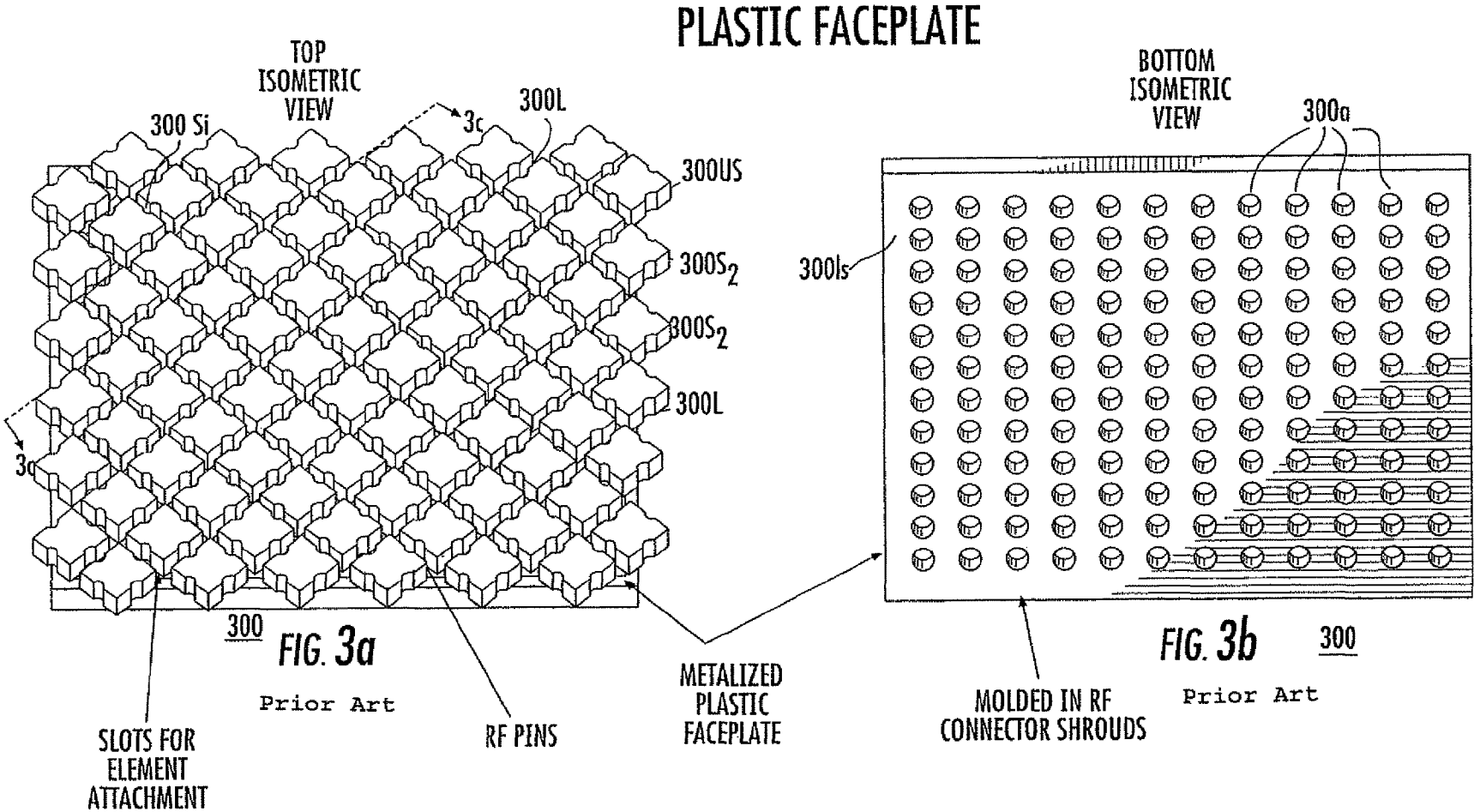
FIG. 3b Prior Art
FIG. 3a Prior Art
FIG. 3*a* is a simplified perspective or isometric view of the upper side of an electrically conductive prior art ground plane useful with the antenna elements.
FIG. 3*b* is a view of the lower side of the structure of FIG. 3*a*.
Figure 3C:
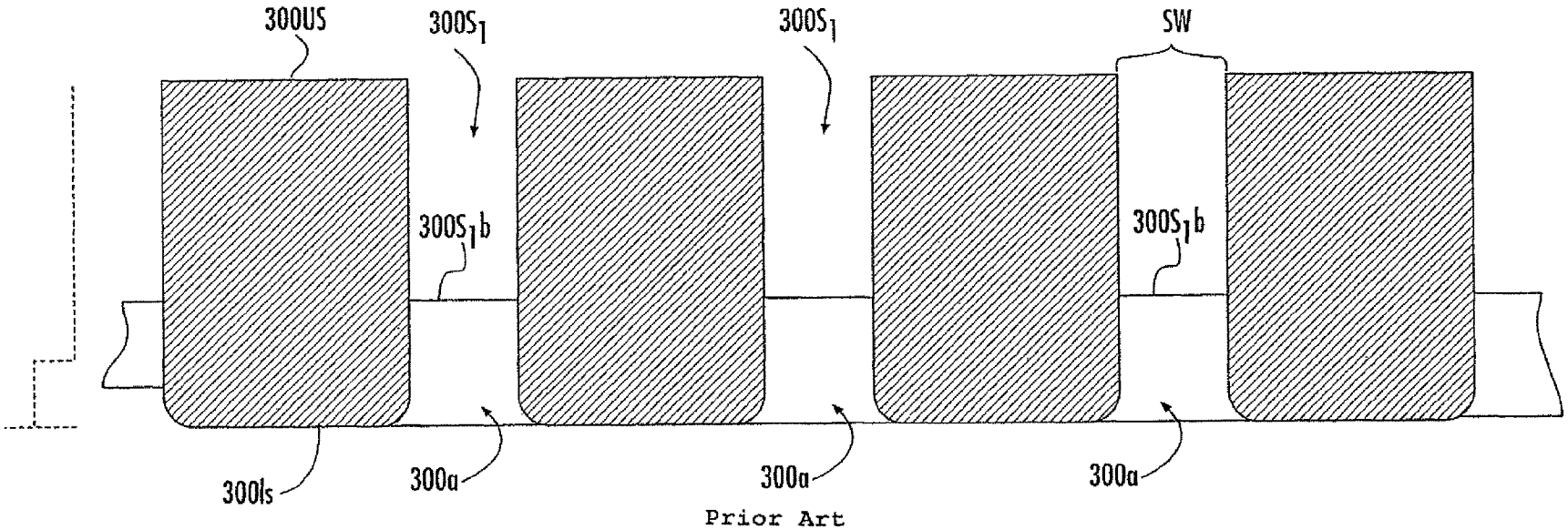
Prior Art FIG. 3c
FIG. 3*c* is a cross-section of the structure of FIG. 3*a*.
Figure 3D:
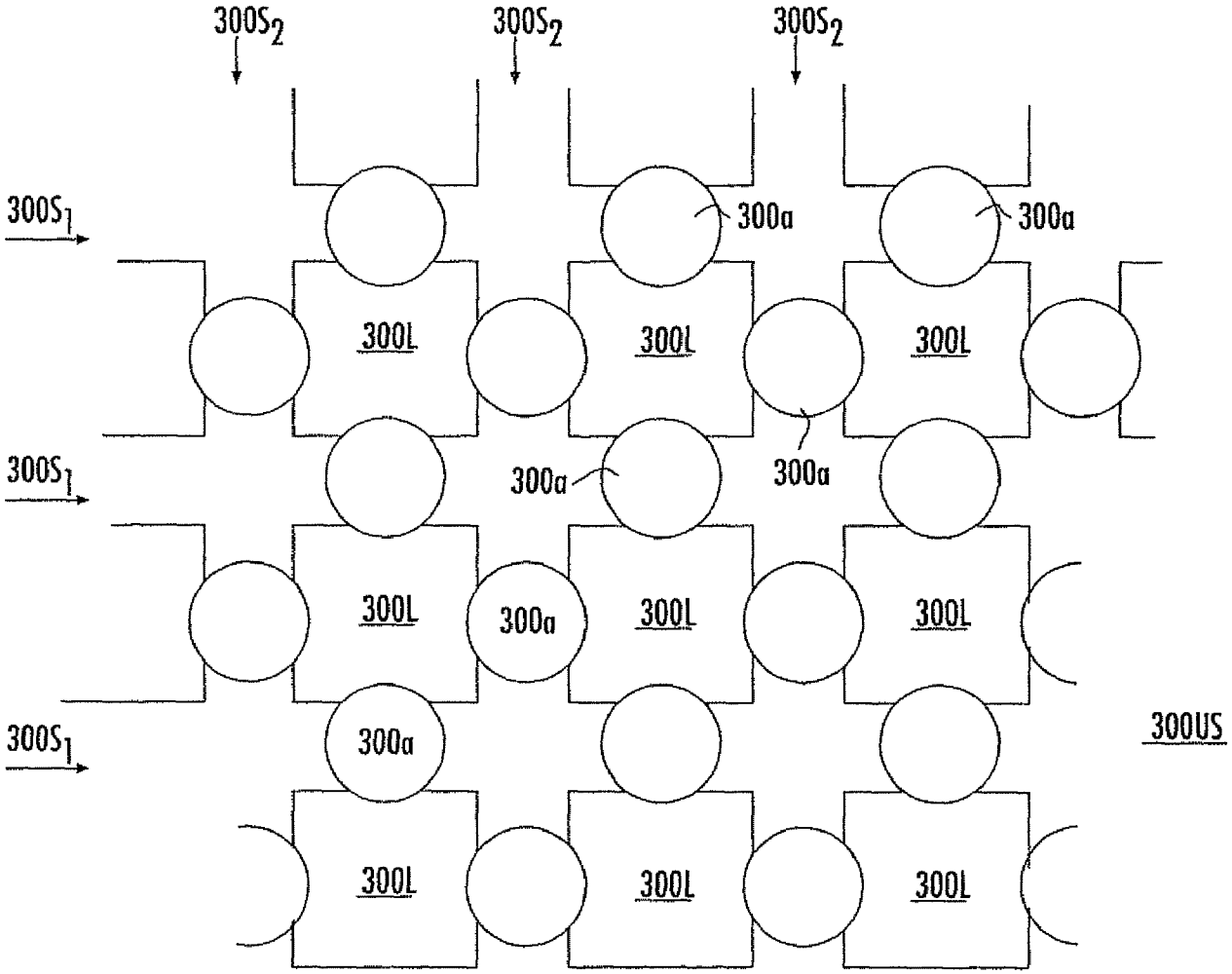
Prior Art FIG. 3d
FIG. 3*d* is a plan view of the upper side of FIG. 3*a;*
Figure 4:
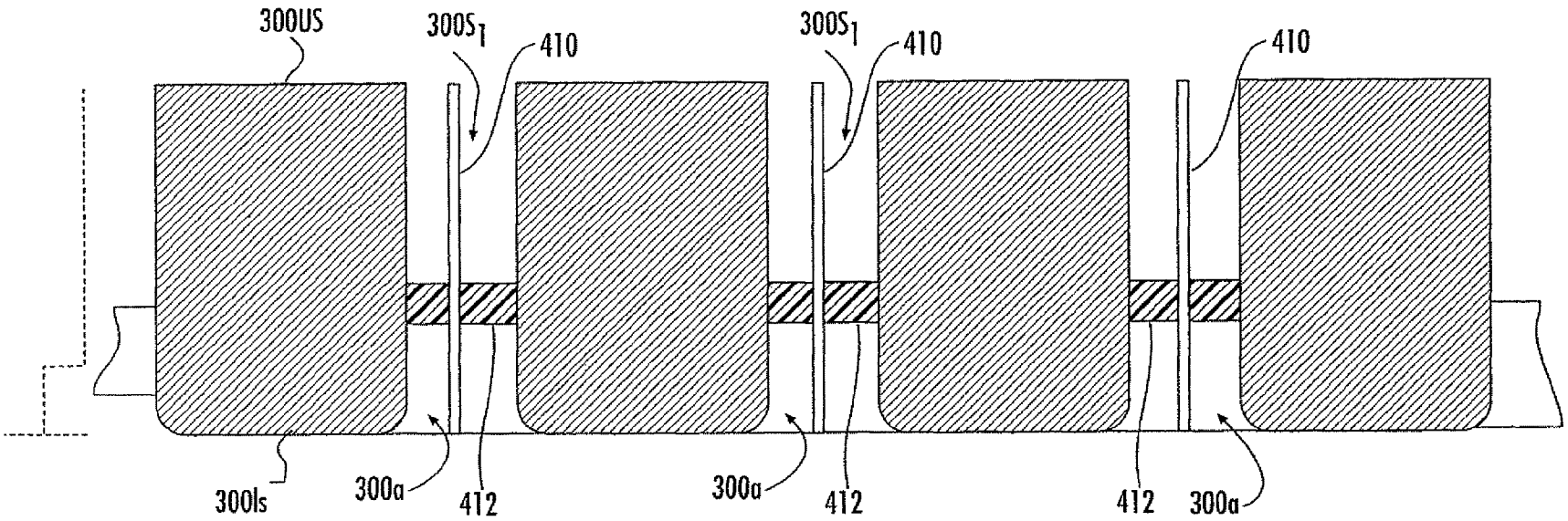
Prior Art FIG. 4
FIG. 4 is a cross-section similar to that of FIG. 3*c*, illustrating feed pins supported by the ground plane but isolated therefrom, for making contact with the feed points of the antennas.
Figures 5A, 5B, 5C, 5D:
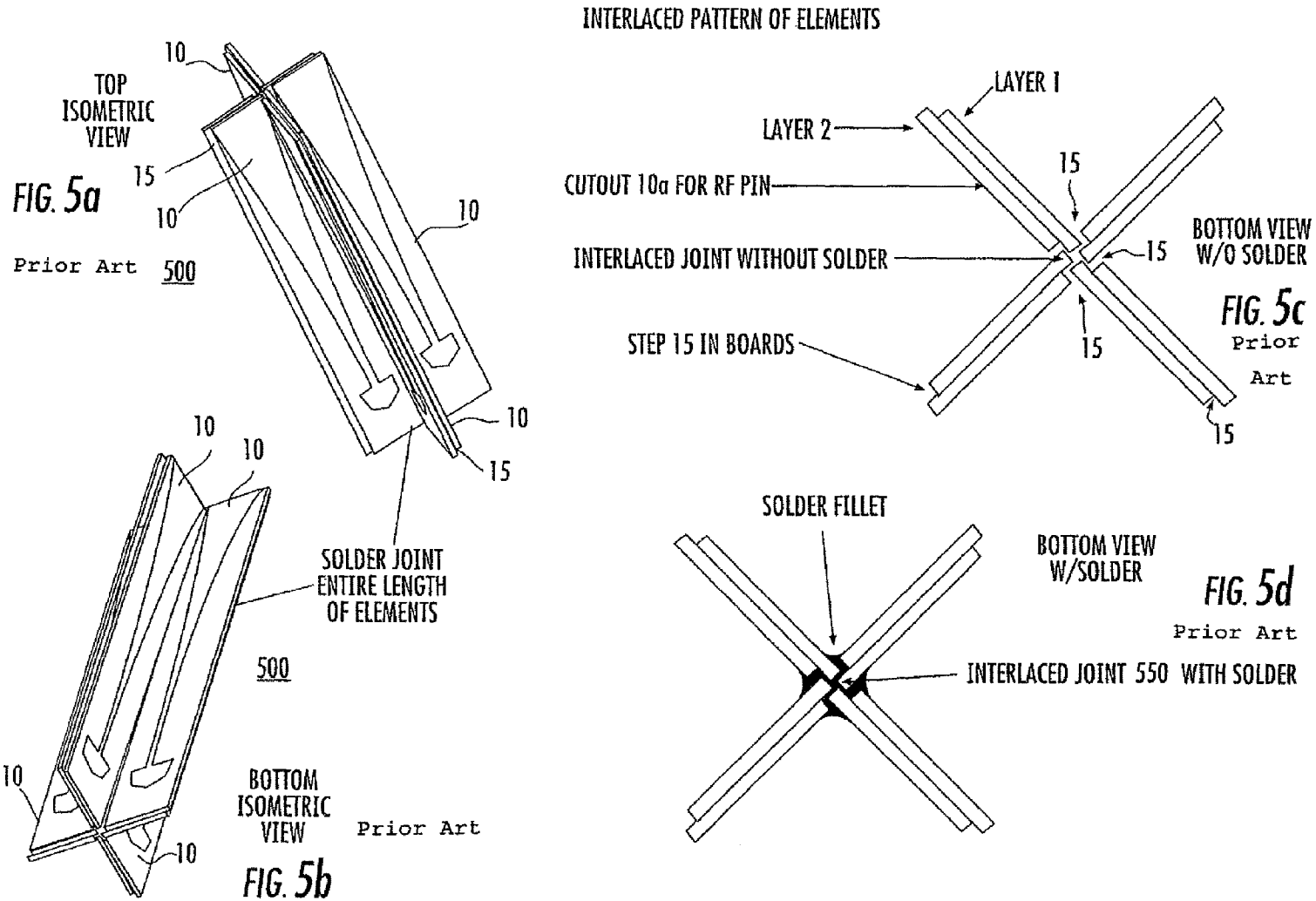
FIG. 5a Prior Art
FIG. 5b Prior Art
FIG. 5c Prior Art
FIG. 5d Prior Art
FIGS. 5*a* and 5*b* are top and bottom, respectively, isometric views of an assemblage of four horn antenna elements such as the one illustrated in FIG. 1.
FIG. 5*c* is an end or plan view of the structure of FIG. 5*a* before the performance of a fusing step.
FIG. 5*d* is similar to FIG. 5*c* after the fusion step.
Figure 8B:
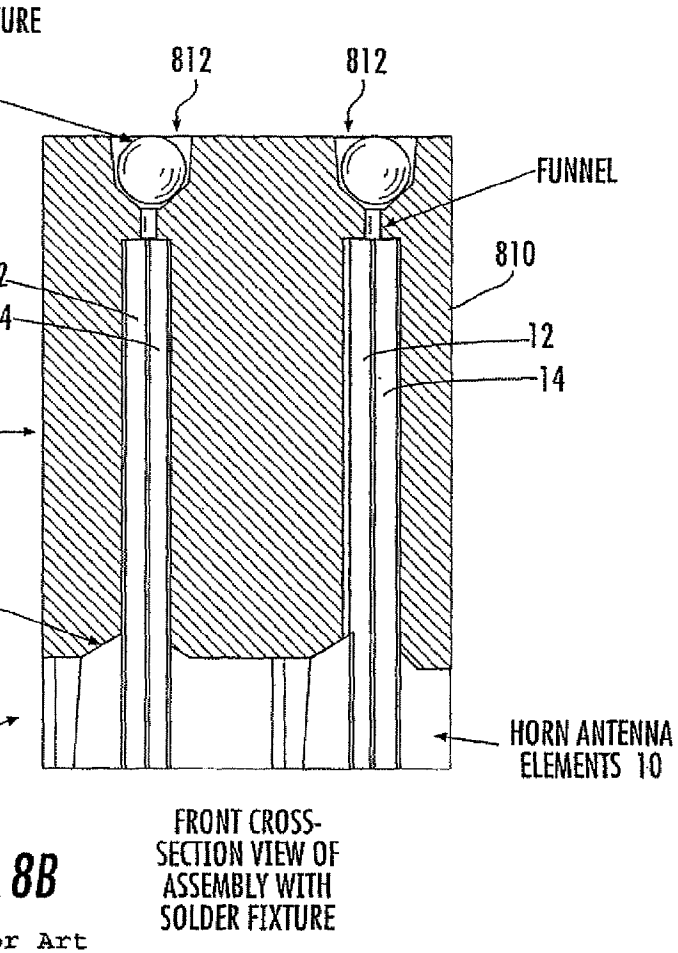
FIG. 8B Prior Art
FIG. 8*b* is a cross-section of the solder fixture of FIG. 8*a* to illustrate how solder balls can be placed therein for helping to prevent voids in the fused solder
Figure 8A:
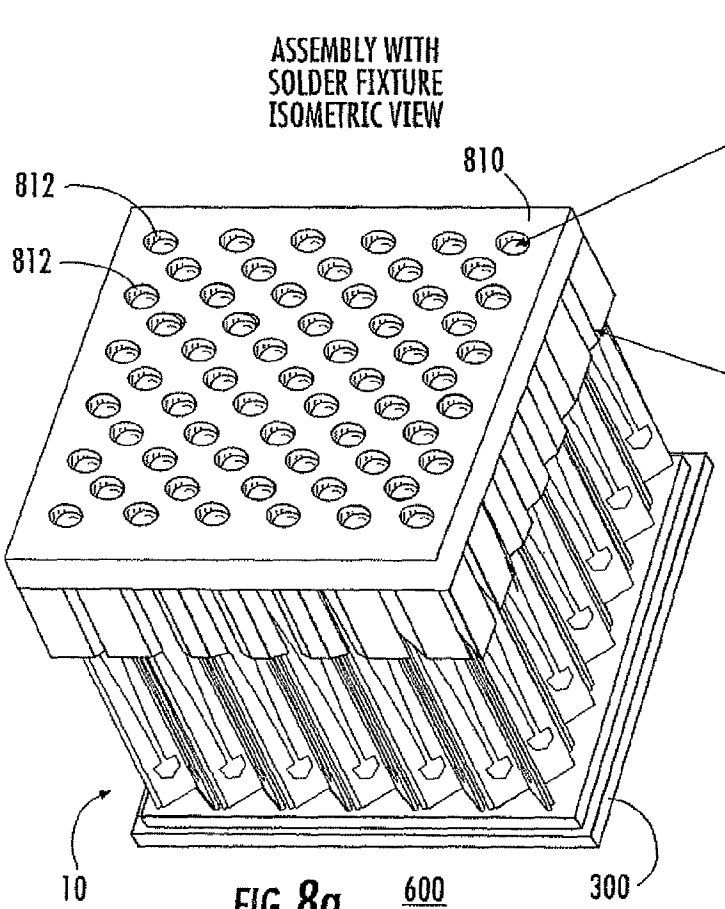
FIG. 8a Prior Art
FIG. 8*a* is a top isometric view of the horn array antenna of FIG. 6 fitted with a solder fixture for holding the upper ends of the horn elements of the array in place during fusing or soldering according to the prior art.

The "phase center" of an antenna is that point from which the far-field radiation appears to emanate. The exact location can be difficult to pinpoint, because of local field effects which occur when making measurements near an antenna. In an array antenna responsive to mutually orthogonal polarizations, deviations between the locations of the phase centers of the antenna portions responsive to the two different polarizations can lead to differences in the response to circular or elliptical polarization which depend upon the aspect angle. In other words, the axial ratio of the combination of antenna elements depends upon the aspect angle or the angle from which the radiation arrives. An interesting attribute of the structure 1210 of FIG. 12*a* is that the horn antenna arrays defined by the patterns described in conjunction with FIGS. 10*a*, 10*b*, 11*a*, and 11*b*, when mounted as described in conjunction with FIGS. 12*a* and 12*b* and energized with electromagnetic energy, have the phase centers of each pair of mutually orthogonal horns centered on the common axes of sets 1008 and 1108 of axes, rather than being offset to the sides of the longitudinal axes of the horns, as in the prior art arrangement described in conjunction with FIGS. 5*d* and 6. Offsets between the phase centers of the vertical (V) and horizontal (H) radiators (either set of horns can be deemed to be the V or the H radiator) can adversely affect the response to or generation of circular or elliptical polarization at various angles off boresight of the array. Thus, the structure described in conjunction with FIGS. 10*a*, 10*b*, 11*a*, 11*b*, 12*a*, and 12*b* is advantageous over the prior art.

Figure 12B:
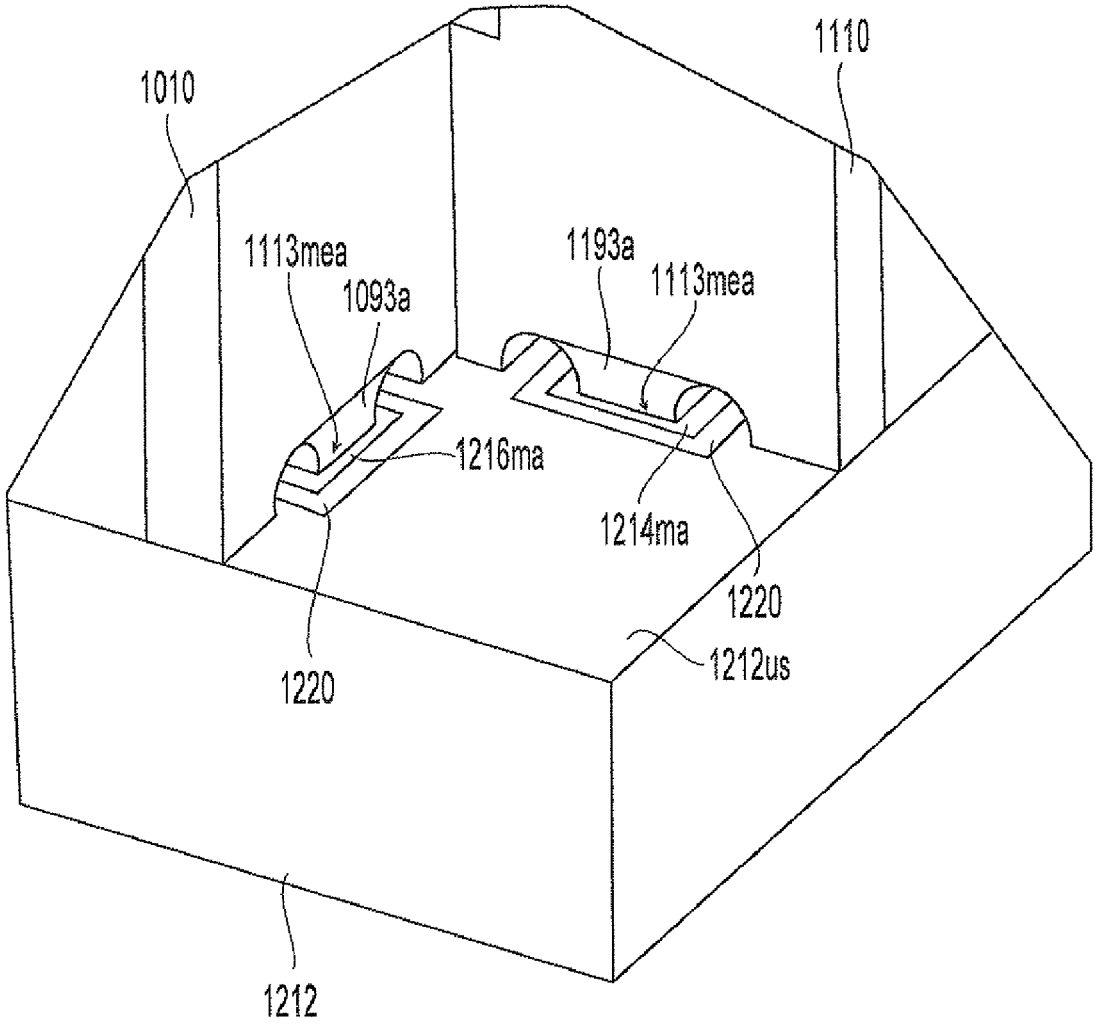
FIG. 12*b* is a detail thereof.

According to another aspect of the invention, the joined boards 1010 and 1110 of structure 1210 of FIGS. 12*a* and 12*b* are mounted on a support structure 1212 which includes surface metallizations or electrical conductors adapted to mate with the feed-end contact pads of sets 1013*me* and 1113*me*. In FIG. 12*b*, at least the entire upper surface 1212*us* is covered by an electrically conductive material (which may be a metallization). A plurality of moats (regions without conductive material or metallization) 1220 define surface contact pads, such as pads 1214*ma* and 1216*ma*, and isolate them from the general ground metallization on surface 1212*us*. FIG. 12*b* illustrates matings, namely the mating of a contact pad 1013 (visible only as an edge) with surface metallization 1216*ma*, and the mating of a contact pad 1113*mea*, also visible only as an edge, with surface metallization 1214*ma*. Electrical contact of matings such as those of FIG. 12*b* cannot be relied upon if the mating surfaces are merely pressed together, so it is advisable to use an electrically conductive interstitial material, which may be a conductive adhesive or a fusion bond.

Figure 13A:
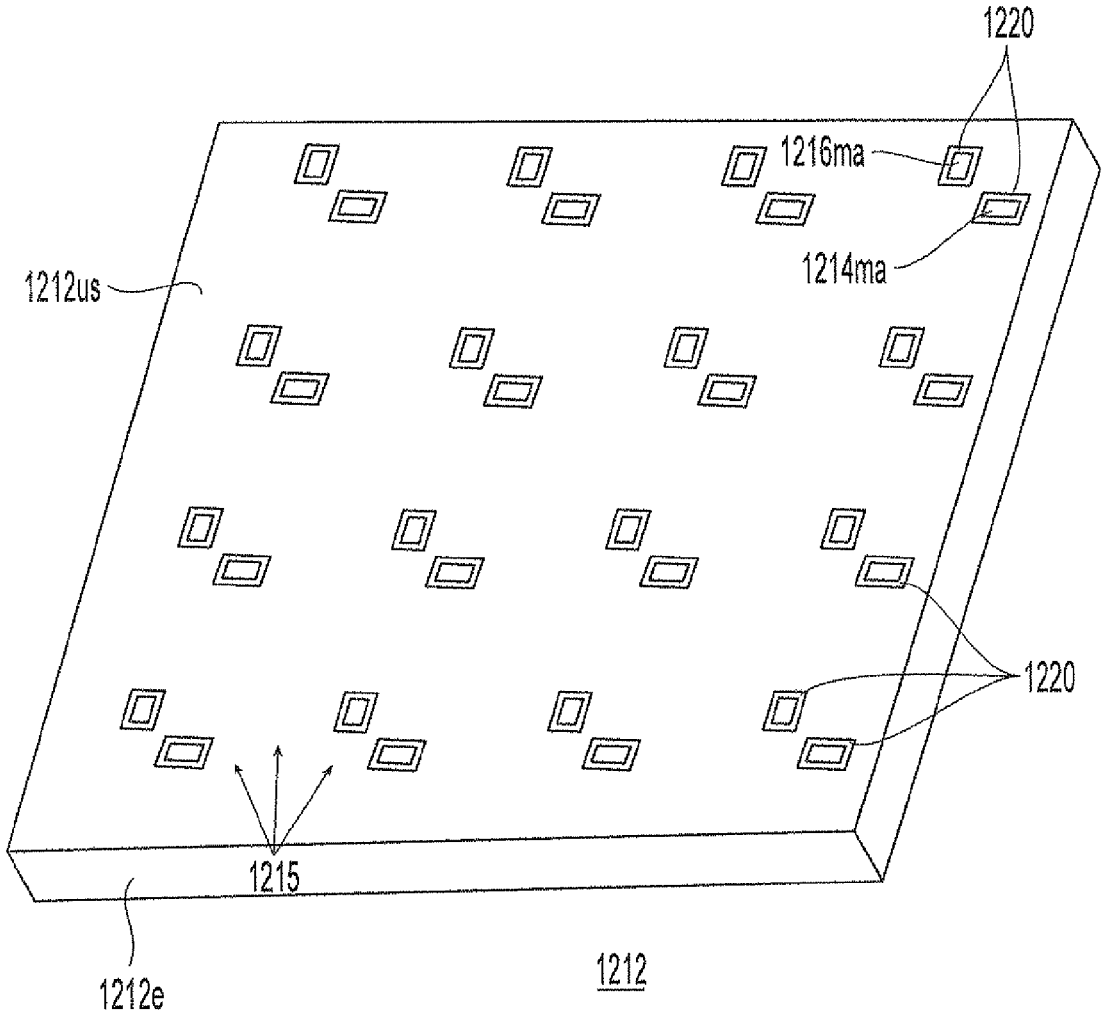
FIG. 13*a* is a simplified perspective or isometric view of the base of FIG. 12*a* separate from the array of antennas.
Figure 13B:
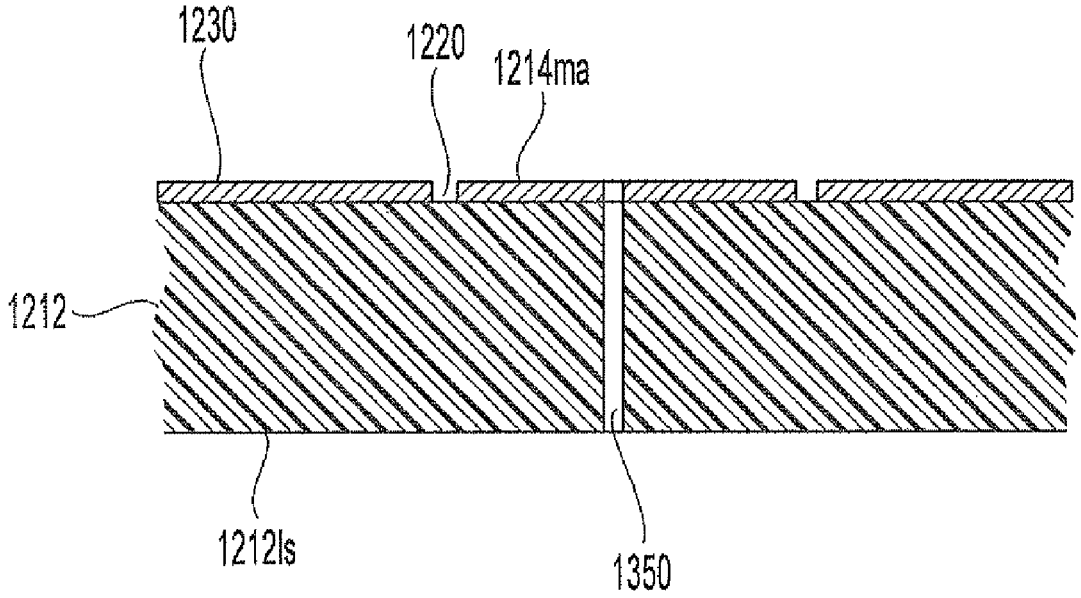
FIG. 13*b* is a cross-sectional view of the structure of FIG. 13*a*.

FIG. 13*a* illustrates support or base 1212 of FIGS. 12*a* and 12*b* in isolation, so the pattern of the set 1215 of surface pads or contacts can be seen. As a more specific example, the surface pads 1214*ma* and 1216*ma* of FIG. 12*b* are illustrated in FIG. 13*a*. FIG. 13*b* is a cross-section of the structure 1212 of FIG. 13*a* in a region near the surface pad 1214*ma*. As illustrated in the cross-section of FIG. 13*b*, surface pad 1214*ma* is connected by an electrically conductive through via 1350 to a lower surface 1212*ts* of support 1212. Each of the surface pads of set 1215 can be independently coupled by a through via to an individual planar conductor (not illustrated) located at a "lower" level of the structure. In this manner, each horn antenna which is electrically connected to a surface pad of the support structure can be independently connected to a selected port of a distribution apparatus. The distribution apparatus in one advantageous embodiment of the invention is a beamformer. Beamformers are well known in the art, and details thereof are not a part of the invention.

Figure 14:
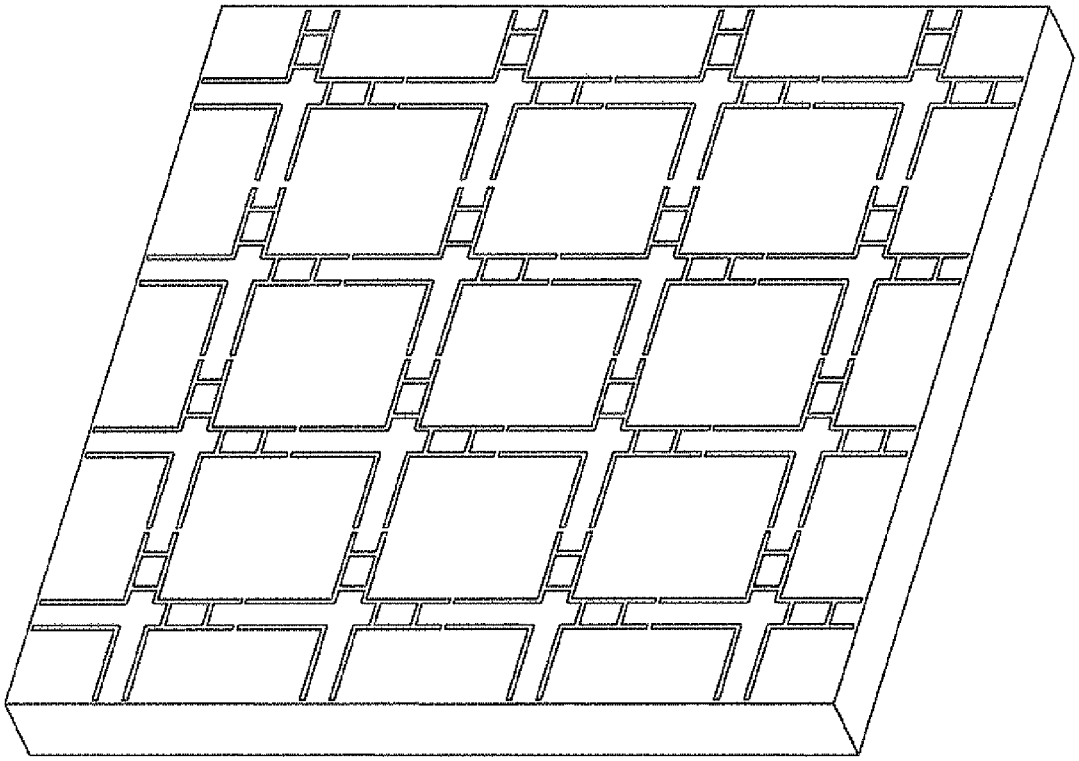
FIG. 14 is a perspective or isometric view of an alternative layout of a base for the antenna structure of FIG. 12*a*.

FIG. 14 illustrates a perspective or isometric view of another possible surface metallization pattern which can be applied to the support for the horn array. In FIG. 14, the pattern of moats defines the same contact pads as the pattern of FIG. 13*a*, but also isolates certain portions of the "ground plane" from other portions.

A method according to an aspect of the invention is for making a planar slot antenna (910), and comprises the step of procuring a dielectric board (912, 914). The dielectric board (912, 914) so procured defines first (912*us*) and second (914*ts*) broad sides, and also defines a feed edge (913) at a feed end (910FE) of the dielectric board (912, 914). The dielectric board (912, 914) includes an electrically conductive slot antenna feed structure (916, 918) extending along a plane (911) lying parallel with, and between, the planes of the first (912*us*) and second (seen in edge view) broad sides. The feed structure (916, 918) includes a strip conductor (916) extending (as 916*e*) to the feed edge (913). The method also includes the step of applying electrically conductive material (912*m*), which may be a metallization, to at least the first broad side (912*us*) of the dielectric board (912, 914) and to at least a portion of the feed edge (913) including the strip conductor (916*e*). The application of electrically conductive material defines the slot antenna (930) on at least the first broad side (912*us*) of the dielectric board (912, 914) in registry with the feed structure (916, 918). The application of the electrically conductive material also defines an electrically conductive connection pad (913*me*) on the feed edge, in contact with the strip conductor (916*e*), and galvanically isolated (by apertures 991, 992 and strips 993) from the electrically conductive material (912*m*) defining the slot antenna (930). The application of electrically conductive material to at least the first broad side (912*us*) of the dielectric board (912, 914) may include the step of applying the electrically conductive material to (a) the second broad side (914*ts*) of the dielectric board (912, 914) to thereby define a portion of the slot antenna, and (b) to portions of the feed edge (913*m*) remote or disconnected from the connection pad (913*me*).

A method according to another aspect of the invention is for making an element of an antenna array, and includes the step of procuring a dielectric first board 912) defining first (912*us*) and second (912*ts*) broad sides, and also defining a feed edge (upper part of 913) adjacent a feed end (910FE) of the first board (912). The first board (912) bears on its second broad side (912*ts*) an electrically conductive pattern (916, 918) defining a feed structure for a slot antenna, which feed structure includes a strip conductor (916) extending (as 916*e*) to the feed end (910FE) edge (upper part of 913) of the first board (912). The method also includes the step of procuring a dielectric second board (914) defining first (914*ts*) and second (plane coincident with 912*ts*) broad sides, and also defining a feed end edge (lower part of 913) adjacent a feed end (910FE) of the second board (914). The second side (912*ts*) of the first board (912) is coupled to the second side of the second board (914) so as to sandwich the feed structure (916, 918) between coupled first and second boards. Electrically conductive material (912*m*, 913*m*) is applied to the first sides (912*us*, 914*ts*) of the coupled first (912) and second (914) boards and to the feed ends (913) of the coupled first (912) and second (914) boards in a pattern which defines the slot antenna (930), and which galvanically connects the feed structure (916, 918) to the electrically conductive material (912*m*, 914*m*) on the first sides (912*us*, 914*ts*) of the first (912) and second (914) boards. The feed structure (916, 918) is galvanically isolated from the electrically conductive material (912*m*, 914*m*) on the first sides (912*us*, 914*ts*) of the coupled first (912) and second (914) boards to thereby make the feed structure (916, 918) accessible by way of the strip conductor (916) at the feed ends (910FE) of the coupled first (912) and second (914) boards. In one mode of this method, the step of galvanically isolating includes the step of defining apertures (991, 992) at the feed end (910FE) of the coupled first (912) and second (914) boards on both sides (adjacent to and on either side) of the feed end (916*e*) of the strip conductor (916).

A method according to another aspect of the invention is for making a horn antenna (930), and comprises the step of procuring a dielectric first board (912) defining first (912*us*) and second (912*ts*) broad sides, and also defining a feed end edge (913) adjacent a feed end (910FE) of the first board (912). The first board (912) bears an electrically conductive material (912*m*) on the first broad side thereof (912*us*), which electrically conductive material (912*m*) defines a slot horn (930). The first board (912) also bears an electrically conductive material on the second broad side (912*ts*) defining a feed structure (916, 918) adjacent the feed end (910FE) edge 913) of the first board (912). The feed structure (916, 918) includes a strip conductor (916) extending (as 916*e*) to the feed end edge (913) of the first board (912). The method also includes the step of procuring a dielectric second board (914) defining first (914*ts*) and second (914*us*) broad sides, and also defining a feed end edge adjacent a feed end of the second board. The second board (914) defines on its first broad side (914*ts*) electrically conductive material (914*m*) defining a slot horn including a feed region adjacent the feed end (910FE) of the second board (914). The second broad C side of the first board (912) is juxtaposed with the second broad side (914*us*) of the second board (914) to thereby generate juxtaposed boards (912, 914) defining a horn antenna element (930) and a feed structure (916, 918) with a strip conductor sandwiched between the first (912) and second (914) boards. At least a portion of the dielectric material of the first (912) and second (914) boards is rendered conductive or metallized in a region (913*me*) adjacent the feed end (916*e*) of the strip conductor (916), but which is not connected to the electrically conductive material (912*m*, 914*m*) on the first broad sides (914*ts*, 914*us*)) of the first (912) and second (914) boards, to thereby define a feed terminal for the horn (930). In a particular mode of this method, the step of juxtaposing includes the application of fluid adhesive substance (909), which may be a hardenable fluid adhesive, to at least one of (a) the second broad side (912*ts*) of the first board (912) and (b) the second broad (914*ts*) side of the second board (914).

A method according to another aspect of the invention is for making a planar slot antenna array. This method comprises the step of procuring a dielectric board (1012) defining first and second broad sides, and also defining a feed edge (1013) at a feed end (1012FE) of the dielectric board (1012). The dielectric board (1012) includes a plurality of electrically conductive slot antenna feed structures (916, 918, 1031*a*, 1031*b*, . . . ) extending along a plane parallel with, and lying between, the planes of the first (1012*us*) and second (1012*ts*) broad sides of the dielectric board (1012). Each of the feed structures (916, 918, 1031*a*, 1031*b*, . . . ) includes a strip conductor (916) extending (as 1016*ea*, 1016*eb*, 1016*ec*, 1016*ed*) to the feed edge (1013) at spaced-apart locations. Electrically conductive material (1012*m*) is applied to at least the first broad side (1012*us*) of the dielectric board (1012) and to at least a portion of the feed edge (1013) including the strip conductor (1016*ea*, 1016*eb*, 1016*ec*, 1016*ed*), to thereby define (a) the plurality of the slot antennas (1030*a*, 1030 *b*, . . . ) on at least the first broad side (1012*us*) of the dielectric board, where each of the slot antennas (1030*a*, 1030*b*, . . . ) is in registry with one of the feed structures (916, 918, 1031*a*, 1031*b*, . . . ) and (b) the plurality of electrically conductive connection pads (1013*mea*, 1013*meb*, . . . ) on the feed edge (1013), where each of the connection pads (1013*mea*, 1013*meb*, . . . ) is in contact with one of the strip conductors (916, 1016). The connection pads (1013*mea*, 1013*meb*, . . . ) are galvanically isolated from the electrically conductive material (1012*m*) defining the slot antennas (1030*a*, 1030 *b*, . . . ). In one mode of this method, the step of applying electrically conductive material (1012*m*) to at least the first broad side (1012*us*) of the dielectric board (1012) and to at least a portion of the feed edge (1013) including the strip conductor (1016*a*, 1016*b*, 1016*c*, 1016*d*), to thereby define the plurality of the slot antennas (1030*a*, 1030*b*, . . . ) on at least the first broad side (1012*us*) of the dielectric board (1012), includes the steps of applying electrically conductive material (1013*m*) to the entirety of the feed edge (1013) including the strip conductors (1016*a*, 1016*b*, 1016*c*, 1016*d*), and removing a portion (1091*a*, 1092*a*, 1093*a*) of the electrically conductive material 91013*m*) adjacent each of the strip conductors (1016*a*, 1016*b*, 1016*c*, 1016*e*). This step of removing may include the step of defining an aperture (1091*a*, 1091*b*) through the dielectric board (1012) at the feed edge (1013) adjacent each of the strip conductors (1016*a*, 1016*b*, 1016*c*, 1016*e*). The step of removing may includes the step of removing a portion of the electrically conductive material from the first (1012*us*), and from the second (1012*ts*) broad side if applicable, of the board (1012) at locations (1093*a*, 1093*b*, 1093*c*, 1093*d*) lying generally between some of the apertures (1091*a*, 1092*a*).

A method according to another aspect of the invention is for making a planar slot antenna array. This method comprises the step of procuring a first dielectric board (1012) defining first (1012*us*) and second (1012*ls*) broad sides, and also defining a feed edge (1013) at a feed end (1012FE) of the first dielectric board (1012) and a radiating end edge (1015) at a radiating end (1012RE) of the first dielectric board (1012). The first dielectric board (1012) includes a plurality of electrically conductive first slot antenna feed structures (916, 918, 1016*e*) extending along a plane parallel with, and lying between, the planes of the first (1012*us*) and second (1012*ts*) broad sides. Each of the first slot antenna feed structures (916, 918, 1016*e*) includes a strip conductor (916) extending to the feed edge (1013) of the first dielectric board (1012) at spaced-apart locations. Electrically conductive material (1012*m*) is applied to at least the first broad side (1012*us*) of the first dielectric board (1012) and to at least a portion of the feed edge (1013) including the strip conductor (1016*ea*, 1016*eb*, . . . ), to thereby define (a) the plurality of first slot antennas (1030*a*, 1030*b*, 1030*c*, 1030*d*) on at least the first broad side (1012*us*) of the first dielectric board (1012), with each of the first slot antennas (1030*a*, 1030*b*, 1030*c*, 1030*d*) being in registry with one of the first slot antenna feed structures (916, 918, 1016*e*), and with the first slot antennas (1030*a*, 1030*b*, 1030*c*, 1030*d*) having mutually parallel axes of symmetry (1080*a*, 1080*b*, 1080*c*, 1080*d*), and (b) the plurality of electrically conductive connection pads (1013*mea*, 1013*meb*, . . . ) on the feed edge (1013), each of which connection pads (1013*mea*, 1013*meb*, . . . ) is in contact with one of the strip conductors (1016*ea*, 1016*eb*, . . . ), and is galvanically isolated from the electrically conductive (1012*m*) material defining the first slot antennas (1030*a*, 1030*b*, 1030*c*, 1030*d*). This method also includes the step of procuring a second dielectric board (1112) defining first (1112*us*) and second (1112*ts*) broad sides, and also defining a feed edge (1113) at a feed end (1112FE) of the second dielectric board (1112) and a radiating edge (1115) at a radiating end (1112RE) of the second dielectric board (1112). The second dielectric board (1112) includes a plurality of electrically conductive second slot antenna feed structures (1116, 1131*a*, 1131*b*, 1131*c*, 1131*d*) extending along a plane parallel with, and lying between, the planes of the first (1112*us*) and second (1112*ts*) broad sides. Each of the second slot antenna feed structures (1116, 1131*a*, 1131*b*, 1131*c*, 1131*d*) includes a strip conductor (1116) extending to the feed edge (1113) at spaced-apart locations. Electrically conductive material (1112*m*) is applied to at least the first broad side (1112*us*) of the second dielectric board (1112) and to at least a portion of the feed edge (1113) including the strip conductor (1116), to thereby define (a) the plurality of second slot antennas (1108*a*, 1108*b*, 1108*c*, 1108*d*) on at least the first broad side (1112*us*) of the second dielectric board (1112), where each of the second slot antennas (1108*a*, 1108*b*, 1108*c*, 1108*d*) is in registry with one of the second slot antenna feed structures (1116, 1131*a*, 1131*b*, 1131*c*, 1131*d*), and the second slot antennas (1108*a*, 1108*b*, 1108*c*, 1108*d*) have mutually parallel axes of symmetry (1108*a*, 1108*b*, 1108*c*, 1108*d*), and (b) the plurality of electrically conductive connection pads (1113*mea*, 1113*meb*, 1113*mec*, 1113*med*) on the feed edge (1113), with each of the connection pads (1113*mea*, 1113*meb*, 1113*mec*, 1113*med*) being in contact with one of the strip conductors (1116*ea*, 1116*eb*, 1116*ec*, 1116*ed*), and galvanically isolated from the electrically conductive material (1112*m*) defining the slot antennas (1108*a*, 1108*b*, 1108*c*, 1108*d*). In this method, the first dielectric board (1012) which is procured further defines a plurality of physical slots (1080*a*, 1080*b*, 1080*c*, 1080*d*), each of the physical slots (1080*a*, 1080*b*, 1080*c*, 1080*d*) of the first dielectric board (1012) extending along the axis of symmetry (1008*a*, 1008*b*, 1008*c*, 1008*d*) of one of the first slot antennas (1030*a*, 1030*b*, 1030*c*, 1030*d*) from the radiating end or edge (1015) of the first dielectric board (1012) and having a length measured from the radiating end or edge (1015) of the first dielectric board (1012). The second dielectric board (1112) which is procured further defines a plurality of physical slots (1180*a*, 1180*b*, 1180*c*, 1180*d*), each of the physical slots (1180*a*, 1180*b*, 1180*c*, 1180*d*) extending along the axis of symmetry (1108*a*, 1108*b*, 1108*d*) of one of the second slot antennas (1130*a*, 1130*b*, 1130*c*, 1130*d*) from the feed end or edge (1115) of the second dielectric board, and having a length measured from the feed end or edge (1115) of the second dielectric board (1112). The lengths of the first (1080*a*, 1080*b*, 1080*c*, 1080*d*) and second (1180*a*, 1180*b*, 1180*c*, 1180*d*) slots are selected so that the first (1012) and second (1112) boards can be joined at a slot with their radiating edges or ends (1015, 1115) coplanar and their feed edges or ends (1013, 1113) coplanar. The method also includes the step of joining the first dielectric board with the second dielectric board by placing one of the boards in a slot of the other one of the boards.

A method according to another aspect of the invention is for making an array antenna (1210). This method comprises the step of procuring a generally rectangular first dielectric board (1010) which defines first and second broad surfaces, and also defines feed (1013) and radiating (1015) end edges lying orthogonal to the first and second broad surfaces. The first dielectric board (1010) defines a slot horn antenna (1030*a*) lying on at least one of the first and second broad surfaces, and defining an axis (1008*a*). The first dielectric board (1010) further defines a first slot (1080*a*) extending along the axis (1008*a*) from the radiating end edge (1015) toward the feed end edge (1013). The first dielectric board (1010) also defines a feed conductor (1013*mea*) lying on and in the plane of the feed edge (1013). The method also includes the step of procuring a generally rectangular second dielectric board (1110) defining first and second broad surfaces, and feed (1113) and radiating (1115) end edges lying orthogonal to the first and second broad surfaces. The second dielectric board (1110) also defines a slot horn antenna (1180*a*) lying on at least one of the first and second broad surfaces. The slot horn antenna defines an axis (1108*a*). The second dielectric board (1110) defines a second slot (1180*a*) extending along the axis (1108*a*) from the feed end edge (1113) toward the radiating end edge (1115), and also defines a feed conductor (1113*mea*) lying on the feed edge (1113) and in the plane of the feed edge (1113). The lengths of the first (1080*a*) and second (1180*a*) slots are selected in conjunction with the lengths of the first (1010) and second (1110) dielectric boards so that when the first (1080*a*) and second (1180*a*) slots of the first (1010) and second (1110) boards are interlinked, the planes of the feed end edges (1013, 1113) of the first (1010) and second (1110) dielectric boards lie in the same plane. According to an aspect of the invention, the first (1080*a*) and second (1180*a*) slots of the first (1010) and second (1110) dielectric boards are interlinked to form an interlinked structure (1210), where the interlinked structure (1210) has the planes of the first and second broad sides of the first (1010) and second (1110) dielectric boards lying in mutually orthogonal planes. When the structures are interlinked, the feed conductors (1013*mea*, 1113*mea*) of the first (1010) and second (1110) dielectric boards define a two-dimensional pattern (1215) lying in the planes of the feed end edges of the first and second dielectric boards (1110). A dielectric base plate (1212, 1412) defining a generally planar broad surface is procured, where the planar broad surface of the dielectric base plate (1212, 1412) defines individual electrically conductive pads (1216*ma*, 1214*ma*) arranged in the two-dimensional pattern. The feed-end edges of the first and second dielectric boards (1110) are affixed to the broad surface of the base plate with the feed conductors of the first and second dielectric board (1110)s registered with the electrically conductive pads and in electrical contact therewith.

What is claimed is:

1. A planar slot antenna, comprising:

a dielectric board defining first and second sides, and also defining a feed edge at a feed end of said dielectric board, said dielectric board including an electrically conductive slot antenna feed structure extending along a plane parallel with, and between, the planes of said first and second sides, said feed structure including a strip conductor extending to said feed edge;

wherein electrically conductive material is disposed on at least said first side of said dielectric board and on at least a portion of said feed edge including said strip conductor, to thereby define (a) said slot antenna on at least said first side of said dielectric board in registry with said feed structure and (b) an electrically conductive connection pad on said feed edge, in contact with said strip conductor, and galvanically isolated from said electrically conductive material defining said slot antenna.

2. The planar slot antenna of claim 1, wherein said electrically conductive material is disposed on (a) said second side of said dielectric board to thereby define a portion of said slot antenna, and (b) portions of said feed edge remote from said connection pad.

3. The planar slot antenna of claim 1, wherein the dielectric board comprises a first dielectric board, the antenna further comprising:

a second dielectric board defining first and second sides and a feed end edge adjacent a feed end of said second dielectric board;

wherein said second side of said first dielectric board is coupled to said second side of said second dielectric board, sandwiching said feed structure between the first dielectric board and the second dielectric board;

wherein electrically conductive material is disposed on said first sides of said coupled first and second boards and to the feed ends of said coupled first and second boards in a pattern defining said slot antenna, and which galvanically connects said feed structure to said electrically conductive material on said first sides of said first and second boards; and wherein said feed structure is galvanically isolated from said electrically conductive material on said first sides of said coupled first and second boards to thereby make said feed structure accessible by way of said strip conductor at said feed ends of said coupled first and second boards.

4. The planar slot antenna of claim 3, wherein apertures are defined at said feed end of said coupled first and second boards on both sides of the feed end of said strip conductor.

5. The planar slot antenna of claim 3, wherein:

said coupled first and second boards further comprise a radiating end edge lying orthogonal to said first and second surfaces, said coupled first and second boards defining a first slot extending along said axis from said radiating end edge toward said feed end edge.

6. The planar slot antenna of claim 3, wherein:

said coupled first and second boards further comprise a radiating end edge lying orthogonal to said first and second surfaces, said coupled first and second boards defining a first slot extending along said axis from said feed end edge toward said radiating end edge.

7. The planar slot antenna of claim 6, wherein apertures are defined at said feed end of said coupled first and second boards on both sides of the feed end of said strip conductor.

8. The planar slot antenna of claim 1, wherein the electrically conductive material comprises metal.

9. An element of an antenna array, comprising:

a dielectric first board defining first and second sides and a feed end edge adjacent a feed end of said first board, said first board having on said second side an electrically conductive material defining a feed structure for a slot antenna, said feed structure including a strip conductor extending to said feed end edge of said first board;

a dielectric second board defining first and second sides and a feed end edge adjacent a feed end of said second board;

wherein said second side of said first board is coupled to said second side of said second board, sandwiching said feed structure between the first and second boards;

wherein electrically conductive material is disposed on said first sides of said coupled first and second boards and to the feed ends of said coupled first and second boards in a pattern defining a slot antenna, and which galvanically connects said feed structure to said electrically conductive material on said first sides of said first and second boards; and wherein said feed structure is galvanically isolated from said electrically conductive material on said first sides of said coupled first and second boards to thereby make said feed structure accessible by way of said strip conductor at said feed ends of said coupled first and second boards.

10. The element of an antenna array of claim 9, wherein apertures are defined at said feed end of said coupled first and second boards on both sides of the feed end of said strip conductor.

11. The element of an antenna array of claim 9, wherein at least a portion of the dielectric material of said first and second boards is metallized in a region adjacent the feed end of said strip conductor, but not connected to said electrically conductive material on said first sides of said first and second boards, to thereby define a feed terminal.

12. The element of an antenna array of claim 9, wherein:

said coupled first and second boards further comprise a radiating end edge lying orthogonal to said first and second surfaces, said coupled first and second boards defining a first slot extending along said axis from said radiating end edge toward said feed end edge.

13. The element of an antenna array of claim 9, wherein:

said coupled first and second boards further comprise a radiating end edge lying orthogonal to said first and second surfaces, said coupled first and second boards defining a first slot extending along said axis from said feed end edge toward said radiating end edge.

14. The element of an antenna array of claim 9, wherein said first and second dielectric boards are connected with a fluid adhesive.

15. A horn antenna, comprising:

a dielectric first board defining first and second sides and a feed end edge adjacent a feed end of said first board, said first board having an electrically conductive material on said first side thereof, which electrically conductive material defines a slot horn, said first board having an electrically conductive material on said second side defining a feed structure adjacent said feed end edge of said first board, said feed structure including a strip conductor extending to said feed end edge of said first board; and a dielectric second board defining first and second sides and a feed end edge adjacent a feed end of said second board, said second board defining on said first side electrically conductive material defining a slot horn including a feed region adjacent said feed end of said second board;

wherein said second side of said first board is juxtaposed with said second side of said second board to thereby define a horn element and a feed structure with a strip conductor sandwiched between said first and second boards; and wherein at least a portion of the dielectric material of said first and second boards is metallized in a region adjacent the feed end of said strip conductor, but not connected to said electrically conductive material on said first sides of said first and second boards, to thereby define a feed terminal for said horn.

16. The horn antenna of claim 15, wherein apertures are defined at said feed end of said coupled first and second boards on both sides of the feed end of said strip conductor.

17. The horn antenna of claim 15, wherein at least a portion of the dielectric material of said first and second boards is metallized in a region adjacent the feed end of said strip conductor, but not connected to said electrically conductive material on said first sides of said first and second boards, to thereby define a feed terminal.

18. The horn antenna of claim 15, wherein:

said juxtaposed first and second boards further comprise a radiating end edge lying orthogonal to said first and second surfaces, said juxtaposed first and second boards defining a first slot extending along said axis from said radiating end edge toward said feed end edge.

19. The horn antenna of claim 15, wherein:

said juxtaposed first and second boards further comprise a radiating end edge lying orthogonal to said first and second surfaces, said juxtaposed first and second boards defining a first slot extending along said axis from said feed end edge toward said radiating end edge.

20. The horn antenna of claim 15, wherein said first and second boards are connected with a fluid adhesive.

* * * * *